US010569592B2

(12) United States Patent
Lister

(10) Patent No.: US 10,569,592 B2
(45) Date of Patent: Feb. 25, 2020

(54) SECURITY DEVICE AND METHOD OF MANUFACTURE

(71) Applicant: DE LA RUE INTERNATIONAL LIMITED, Basingstoke, Hampshire (GB)

(72) Inventor: Adam Lister, Andover (GB)

(73) Assignee: DE LA RUE INTERNATIONAL LIMITED, Basingstoke, Hampshire (GB)

( * ) Notice: Subject to any disclaimer, the term of this patent is extended or adjusted under 35 U.S.C. 154(b) by 0 days.

(21) Appl. No.: 16/098,820

(22) PCT Filed: May 2, 2017

(86) PCT No.: PCT/GB2017/051225

§ 371 (c)(1),
(2) Date: Nov. 2, 2018

(87) PCT Pub. No.: WO2017/194911

PCT Pub. Date: Nov. 16, 2017

(65) Prior Publication Data

US 2019/0176507 A1 Jun. 13, 2019

(30) Foreign Application Priority Data

May 11, 2016 (GB) ..... 1608225.7

(51) Int. Cl.
*B42D 25/29* (2014.01)
*B42D 25/324* (2014.01)
(Continued)

(52) U.S. Cl.
CPC ..... *B42D 25/29* (2014.10); *B42D 25/324* (2014.10); *B42D 25/342* (2014.10)

(58) Field of Classification Search
CPC ..... B42D 25/29; B42D 25/324; B42D 25/342
(Continued)

(56) References Cited

U.S. PATENT DOCUMENTS 4,892,336 A 1/1990 Kaule et al.
6,856,462 B1 2/2005 Scarbrough et al.
(Continued)

FOREIGN PATENT DOCUMENTS

EP 0 059 056 B1 5/1985
EP 0 860 298 A2 8/1998
(Continued)

OTHER PUBLICATIONS

Oct. 19, 2016 Search Report issued in Great Britain Application No. 1608225.07.
(Continued)

*Primary Examiner* — Justin V Lewis
(74) *Attorney, Agent, or Firm* — Oliff PLC

(57) ABSTRACT

A security device is provided. The security device comprises an array of elongate focusing structures, the elongate axes of which are aligned along a first direction, the elongate focusing structures being arranged parallel to one another periodically along a second direction which is orthogonal to the first direction, each elongate focusing structure having an optical footprint of which different elongate strips will be directed to the viewer in dependence on the viewing angle, the centre line of each optical footprint being parallel with the first direction. An array of image elements overlap the array of elongate focusing structures, the array of image elements representing elongate image slices of at least two respective images, each image slice comprising one or more image elements, and at least one image slice of each respective image being located at least partially in the optical footprint of each elongate focusing structure. The array of image elements is configured such that the pitch between the elongate image slices of each respective image in the second direction varies across the array in the first and/or second direction(s). At any one viewing angle, in a
(Continued)

Figure 1A:
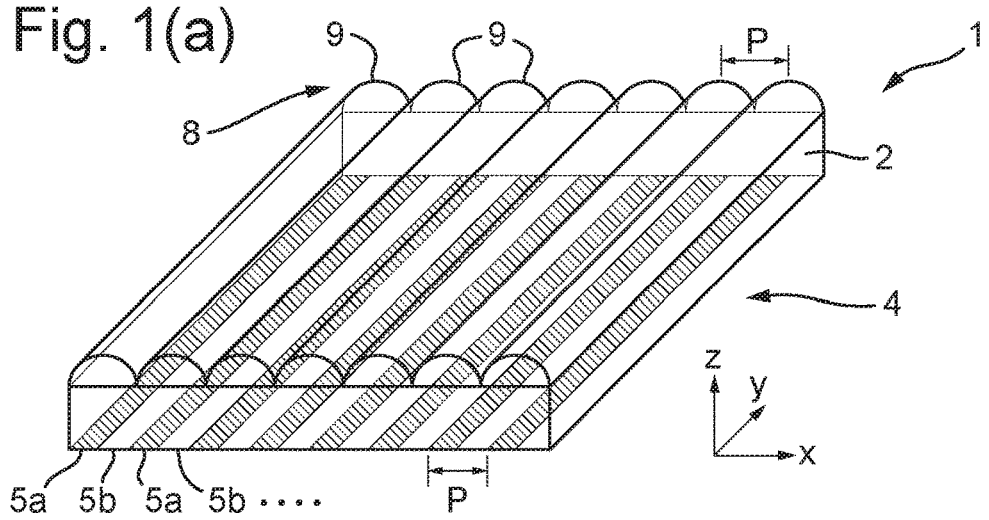
Figure 1B:
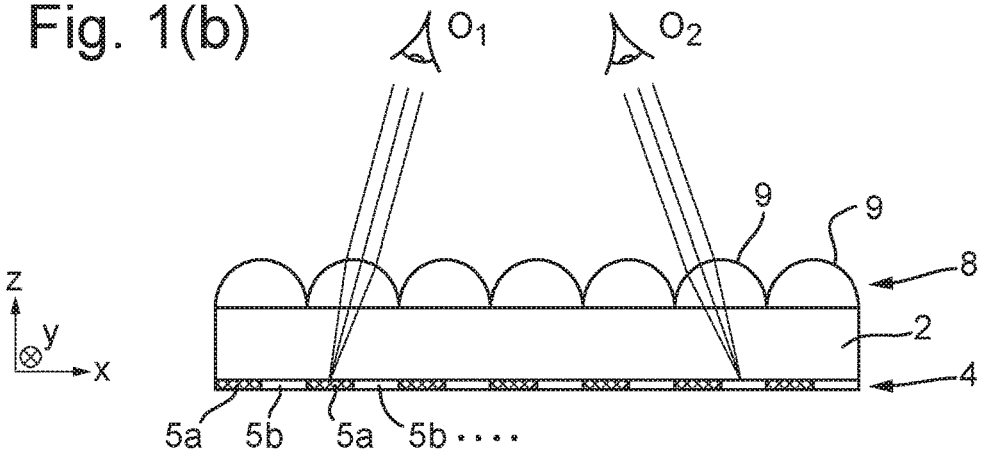
Figure 1C:
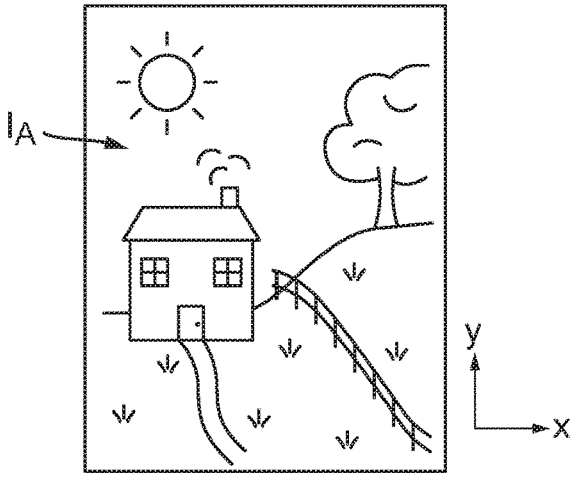
Figure 1D:
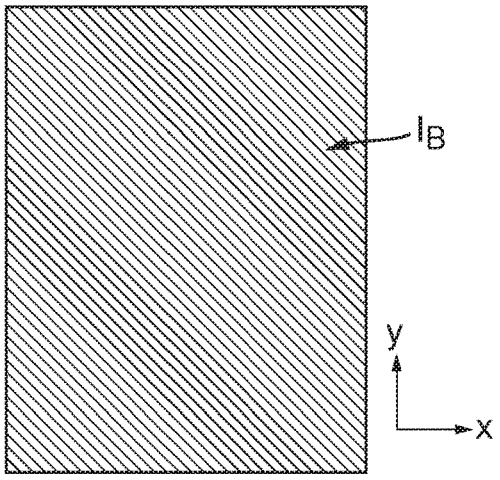
Figure 2A:
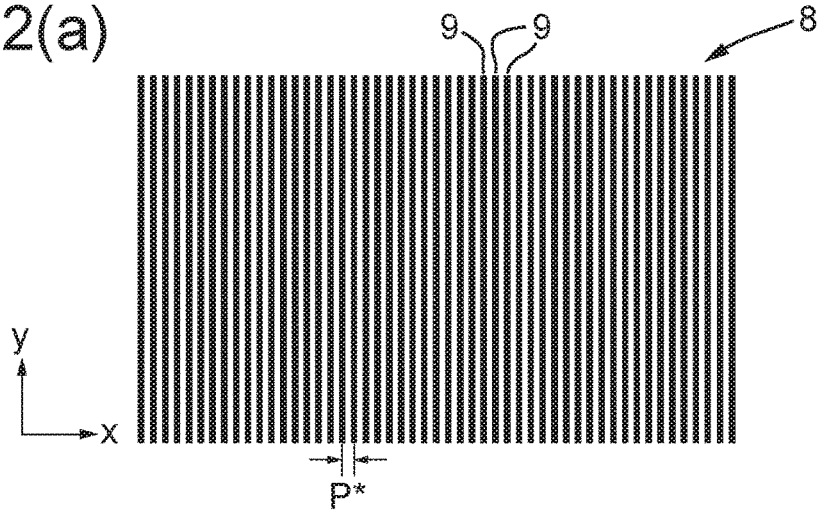
Figure 2B:
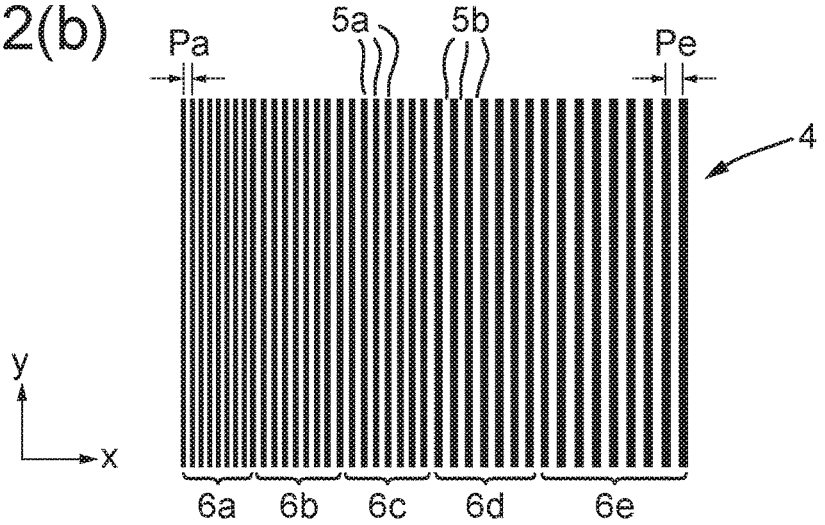
Figure 2C:
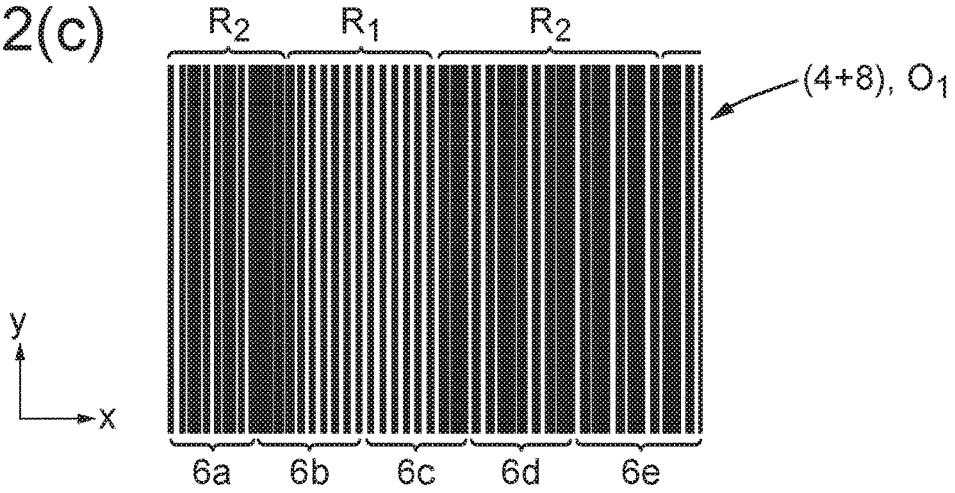
Figure 2D:
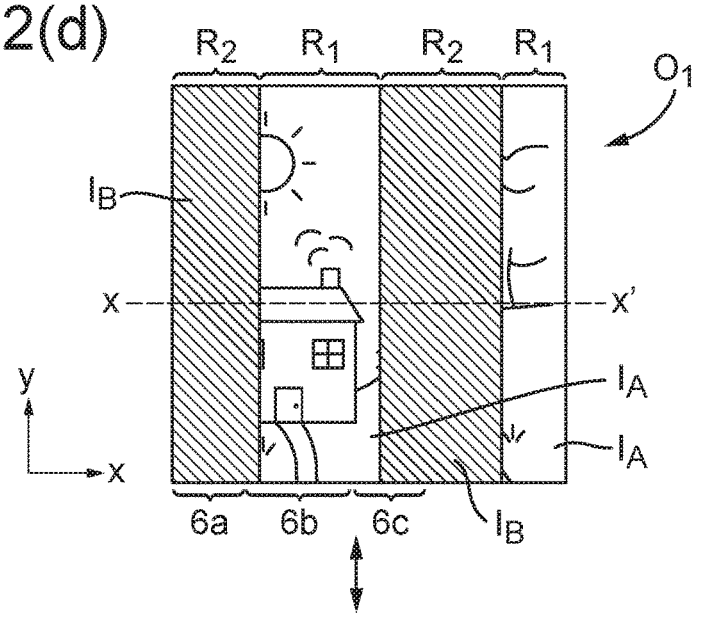
Figure 2E:
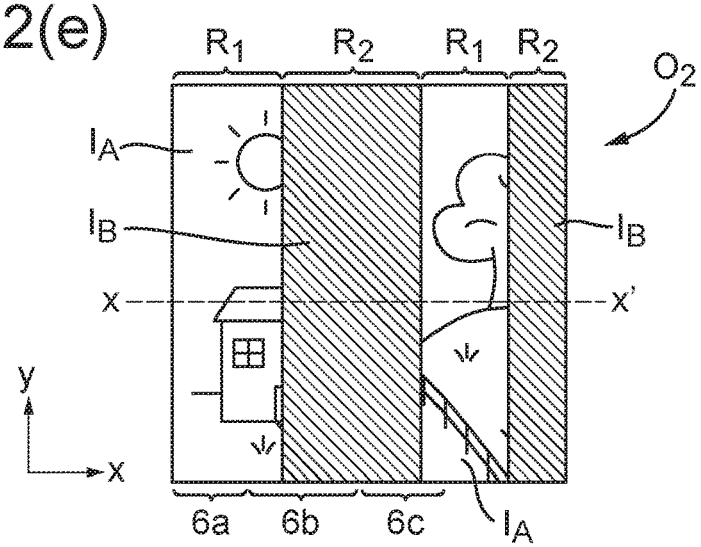
Figure 2F:
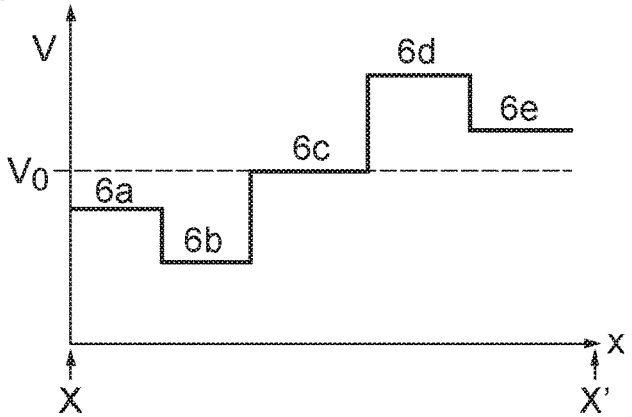
Figure 3A:
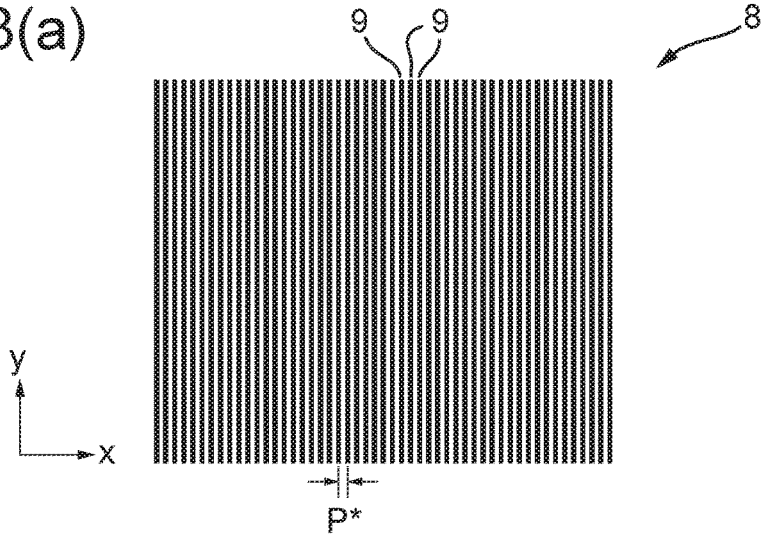
Figure 3B:
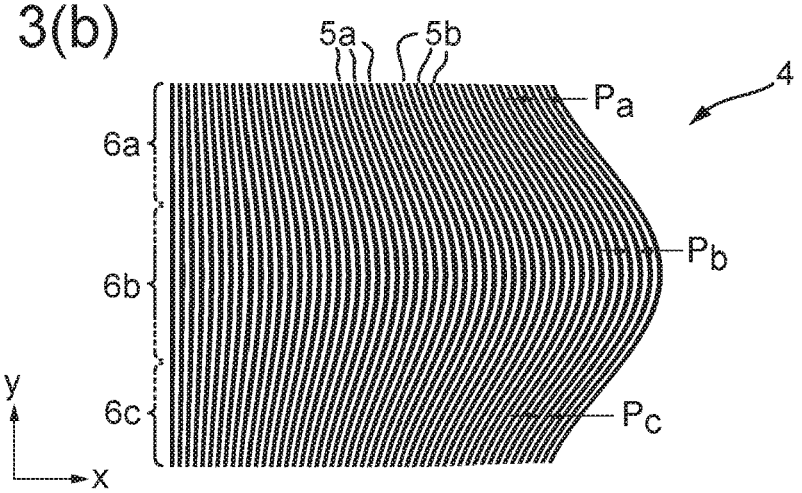
Figure 3C:
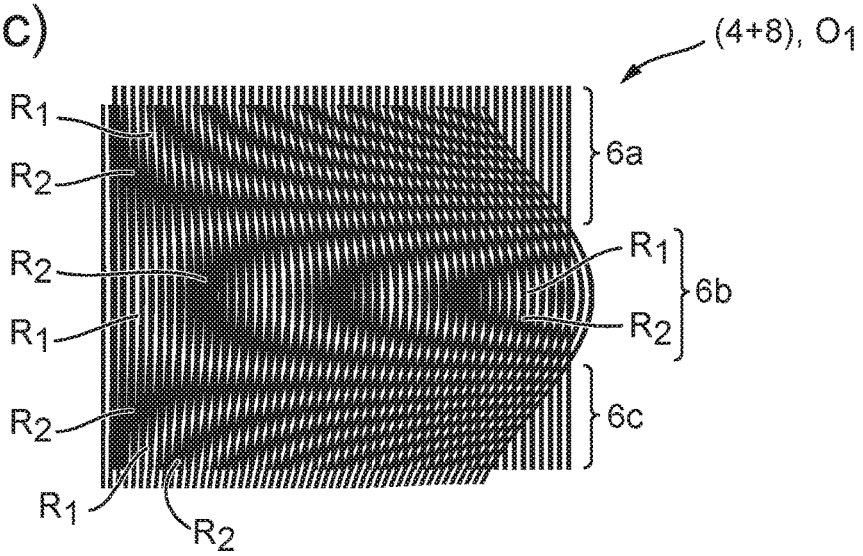
Figure 3D:
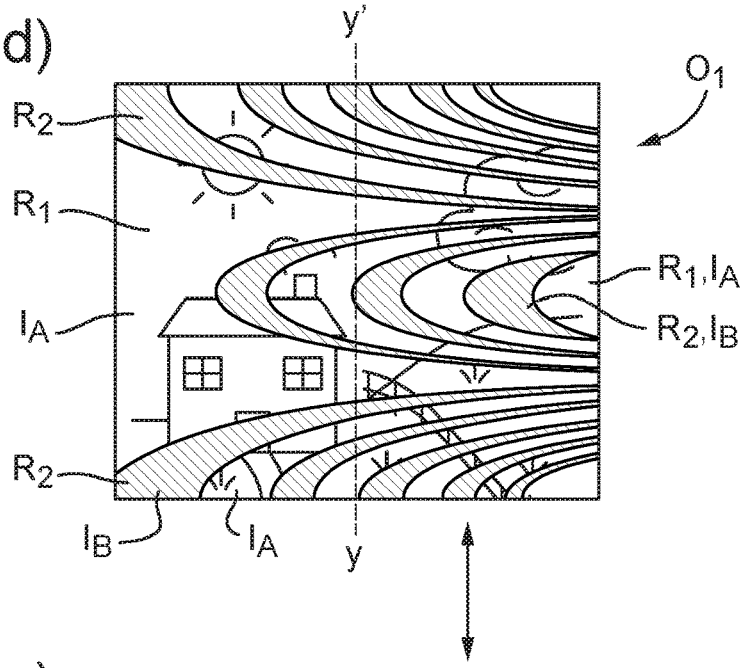
Figure 3E:
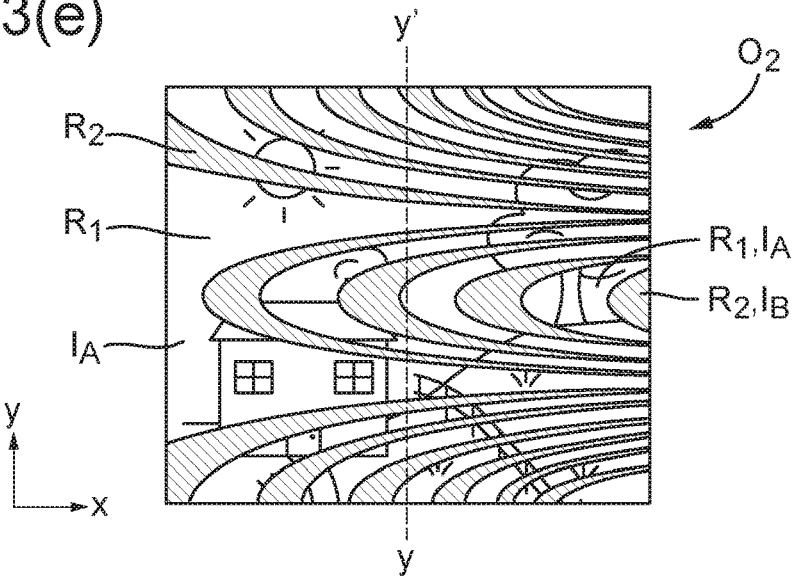
Figure 3F:
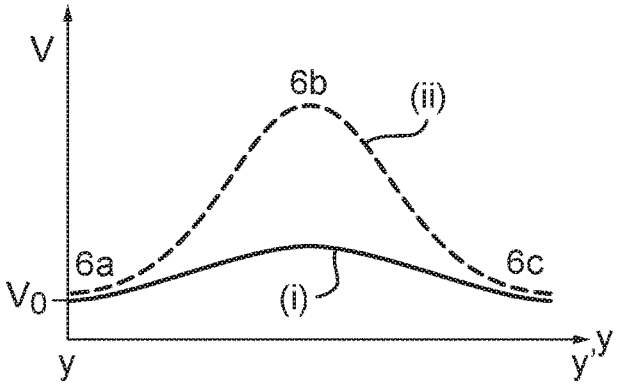
Figure 4A:
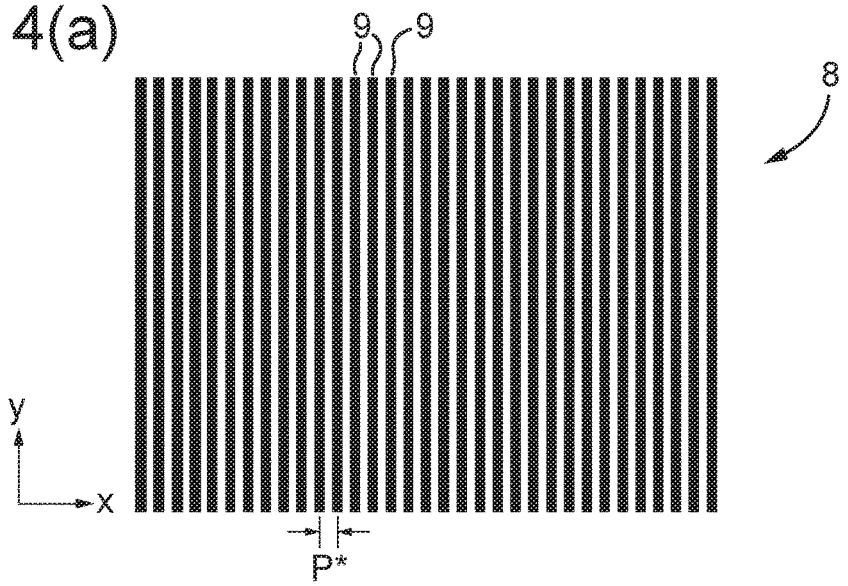
Figure 4B:
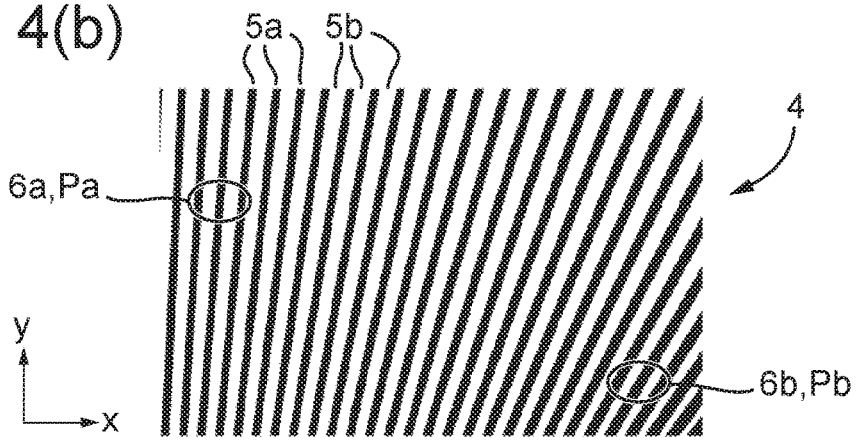
Figure 4C:
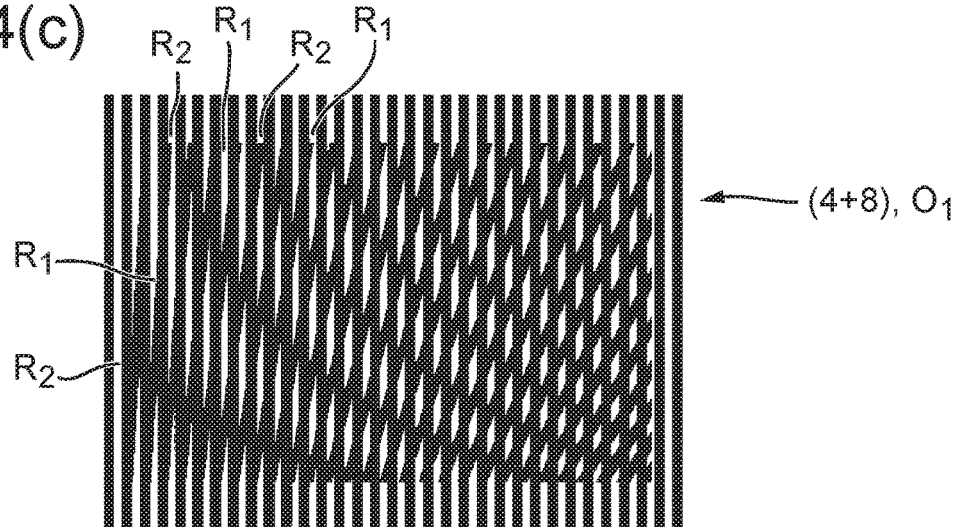
Figure 4D:
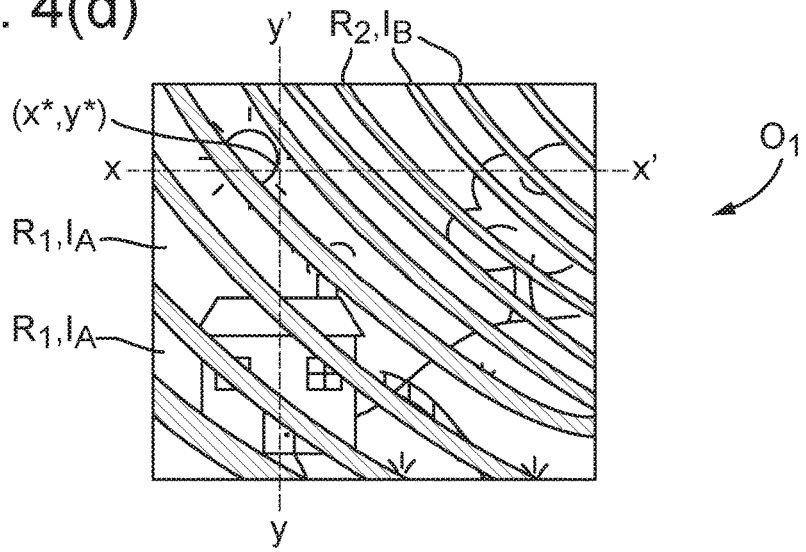
Figure 4E:
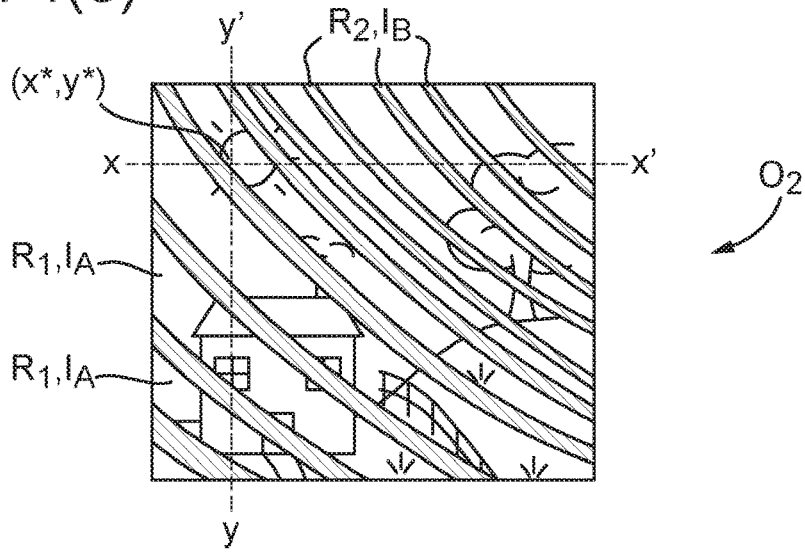
Figure 4F:
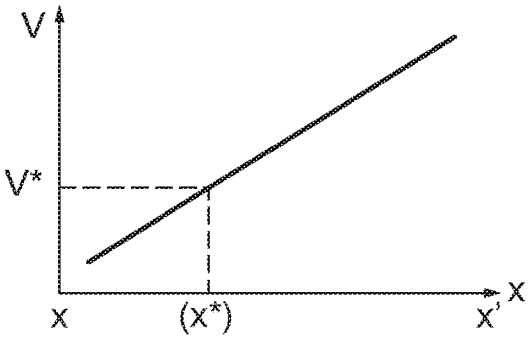
Figure 4G:
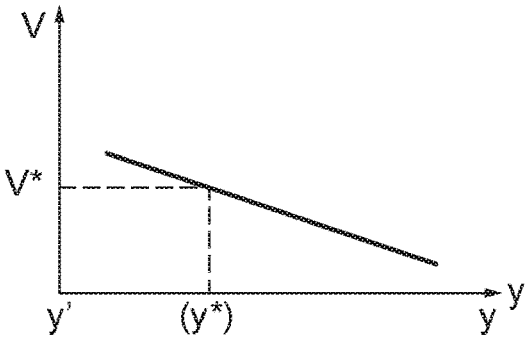
Figure 5A:
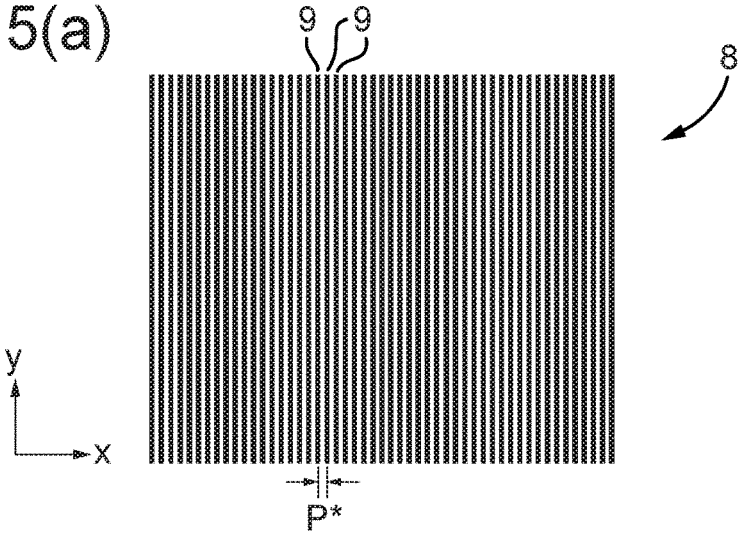
Figure 5B:
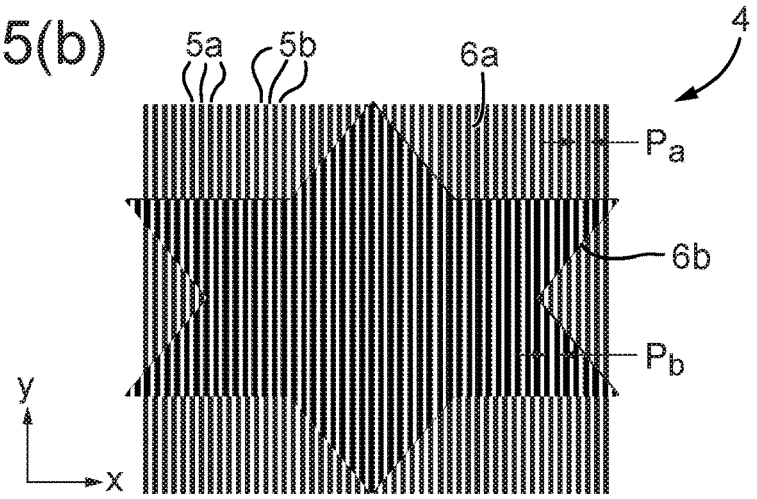
Figure 5C:
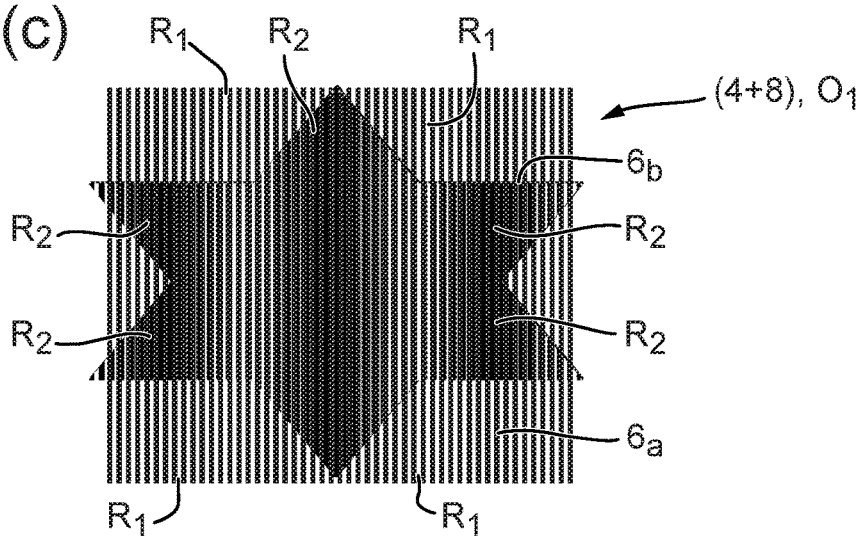
Figure 5D:
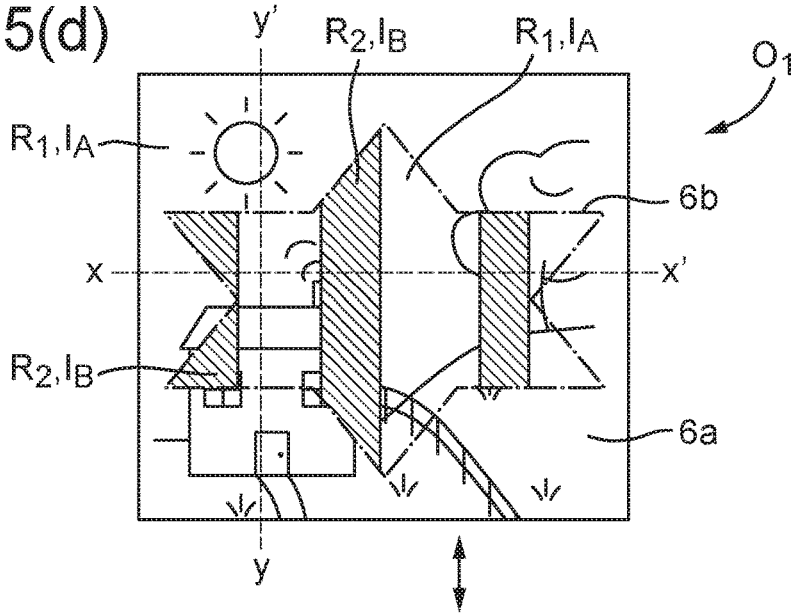
Figure 5E:
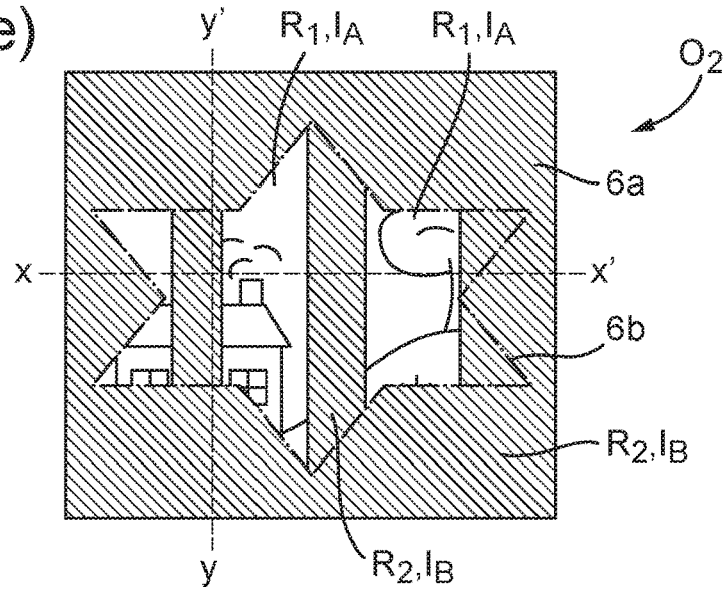
Figure 5F:
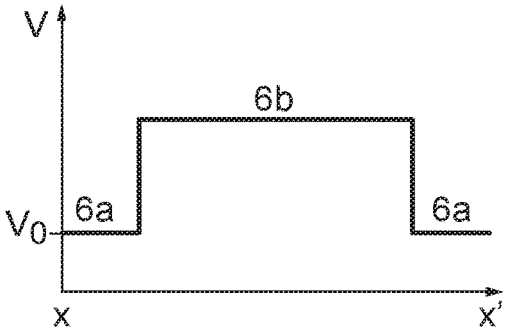
Figure 5G:
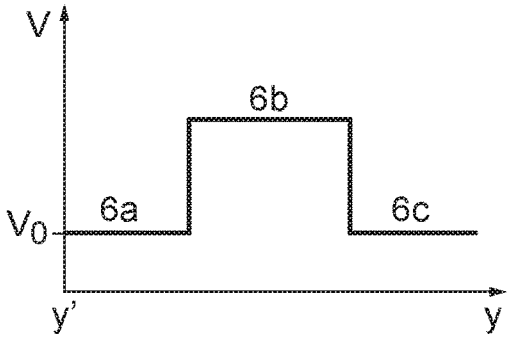

first region of the device the elongate focussing structures direct portions of first image slices corresponding to a first image to the viewer such that the first image is displayed across the first region of the device, and simultaneously, in a second region of the device which is laterally offset from the first region in the first and/or second direction(s), the elongate focussing structures direct portions of second image slices corresponding to a second image to the viewer such that the second image is displayed across the second region of the device, the positions of the first and second regions relative to the security device depending on the viewing angle.

20 Claims, 15 Drawing Sheets

(51) Int. Cl.
*B42D 25/342* (2014.01)
*B42D 25/00* (2014.01)
*B42D 25/328* (2014.01)

(58) Field of Classification Search
USPC ..... 283/67, 72, 94, 98, 901
See application file for complete search history.

(56) References Cited

U.S. PATENT DOCUMENTS

| | | | | |
|---|---|---|---|---|
| 2012/0268598 | A1 | 10/2012 | Holmes et al. | |
| 2014/0191500 | A1* | 7/2014 | Holmes | G02B 27/2214 283/85 |

FOREIGN PATENT DOCUMENTS

| | | | |
|---|---|---|---|
| EP | 1 398 174 | A1 | 3/2004 |
| EP | 2 460 667 | A2 | 6/2012 |
| GB | 2490780 | A | 11/2012 |
| GB | 2536877 | A | 10/2016 |
| GB | 2549215 | A | 10/2017 |
| WO | 83/00659 | A1 | 3/1983 |
| WO | 94/27254 | A1 | 11/1994 |
| WO | 95/10419 | A1 | 4/1995 |
| WO | 95/10420 | A1 | 4/1995 |
| WO | 00/39391 | A1 | 7/2000 |
| WO | 03/054297 | A2 | 7/2003 |
| WO | 03/095188 | A2 | 11/2003 |
| WO | 2005/031687 | A2 | 4/2005 |
| WO | 2005/052560 | A1 | 6/2005 |
| WO | 2005/031687 | A3 | 10/2005 |
| WO | 2005/106601 | A2 | 11/2005 |
| WO | 2005/115119 | A2 | 12/2005 |
| WO | 2008/000350 | A1 | 1/2008 |
| WO | 2011/051669 | A1 | 5/2011 |
| WO | 2011/051670 | A2 | 5/2011 |
| WO | 2011/102800 | A1 | 8/2011 |
| WO | 2011/107782 | A1 | 9/2011 |
| WO | 2011/107783 | A1 | 9/2011 |
| WO | 2012/027779 | A1 | 3/2012 |
| WO | 2014/085290 | A1 | 6/2014 |

OTHER PUBLICATIONS

Aug. 7, 2017 International Search Report and Written Opinion issued in International Application No. PCT/GB2017/051225.

* cited by examiner

SECURITY DEVICE AND METHOD OF MANUFACTURE

This invention relates to security devices, for example for use on articles of value such as banknotes, cheques, passports, identity cards, certificates of authenticity, fiscal stamps and other documents of value or personal identity. Methods of manufacturing such security devices are also disclosed.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. Examples include features based on one or more patterns such as microtext, fine line patterns, latent images, venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One class of security devices are those which produce an optically variable effect, meaning that the appearance of the device is different at different angles of view. Such devices are particularly effective since direct copies (e.g. photocopies) will not produce the optically variable effect and hence can be readily distinguished from genuine devices. Optically variable effects can be generated based on various different mechanisms, including holograms and other diffractive devices, and also devices which make use of focusing elements such as lenses, including moiré magnifier devices and so-called lenticular devices.

Moiré magnifier devices (examples of which are described in EP-A-1695121, WO-A-94/27254, WO-A-2011/107782 and WO2011/107783) make use of an array of micro-focusing elements (such as lenses or mirrors) and a corresponding array of microimage elements, wherein the pitches of the micro-focusing elements and the array of microimage elements and their relative locations are such that the array of micro-focusing elements cooperates with the array of microimage elements to generate a magnified version of the microimage elements due to the moiré effect. Each microimage element is a complete, miniature version of the image which is ultimately observed, and the array of focusing elements acts to select and magnify a small portion of each underlying microimage element, which portions are combined by the human eye such that the whole, magnified image is visualised. This mechanism is sometimes referred to as "synthetic magnification".

Lenticular devices on the other hand do not involve synthetic magnification. An array of focusing elements, typically cylindrical lenses, overlies a corresponding array of image elements, each of which depicts only a portion of an image which is to be displayed. Image slices (made up of one or more image elements) from two or more different images are interleaved and, when viewed through the focusing elements, at each viewing angle, only a selected group of image slices, all from the same image, will be directed towards the viewer. In this way, different composite images can be viewed at different angles. However it should be appreciated that no magnification typically takes place and the resulting image which is observed will be of substantially the same size as that to which the underlying image slices are formed. Some examples of lenticular devices are described in U.S. Pat. No. 4,892,336 A, WO-A-2011/051669, WO-A-2011051670, WO-A-2012/027779 and U.S. Pat. No. 6,856,462 B. WO-A-2014/085290 also discloses an approach to forming the array of image elements which aims to increase the number of different images which may be incorporated and thereby displayed at different viewing angles. Lenticular devices have the advantage that different images can be displayed at different viewing angles, giving rise to the possibility of animation and other striking visual effects which are not possible using the moiré magnifier technique.

New security devices with different appearances and effects are constantly sought in order to stay ahead of would-be counterfeiters.

In accordance with the present invention, a security device is provided, comprising:

an array of elongate focusing structures, the elongate axes of which are aligned along a first direction, the elongate focusing structures being arranged parallel to one another periodically along a second direction which is orthogonal to the first direction, each elongate focusing structure having an optical footprint of which different elongate strips will be directed to the viewer in dependence on the viewing angle, the centre line of each optical footprint being parallel with the first direction; and an array of image elements overlapping the array of elongate focusing structures, the array of image elements representing elongate image slices of at least two respective images, each image slice comprising one or more image elements, and at least one image slice of each respective image being located at least partially in the optical footprint of each elongate focusing structure;

wherein the array of image elements is configured such that the pitch between the elongate image slices of each respective image in the second direction varies across the array in the first and/or second direction(s);

whereby, at any one viewing angle, in a first region of the device the elongate focussing structures direct portions of first image slices corresponding to a first image to the viewer such that the first image is displayed across the first region of the device, and simultaneously, in a second region of the device which is laterally offset from the first region in the first and/or second direction(s), the elongate focussing structures direct portions of second image slices corresponding to a second image to the viewer such that the second image is displayed across the second region of the device, the positions of the first and second regions relative to the security device depending on the viewing angle.

By arranging the image slices in this way, so that their pitch (i.e. the spacing between neighbouring image slices from the same image in the second direction) varies across the device, a new visual effect is generated. Preferred implementations of the elongate focusing structures will be described below, although it should be noted that in some cases these may comprise non-elongate focussing elements, arranged so as to form elongate focusing structures. The optical footprint of each elongate focusing structure will generally correspond in terms of shape and alignment to those of the elongate focusing structure itself, and its centre line is the straight line equidistant from the two long sides of the optical footprint at each location along the first direction (hence the centre line will be parallel to the first direction).

The visual effect exhibited by the disclosed security device arises from the moiré magnification effect described above, combined with the above-mentioned lenticular mechanism. Hence the device can be described as a hybrid moiré-magnifier/lenticular device, in which each image element is a portion (e.g. an individual pixel, or a group or line of pixels) of a corresponding image, not a miniature version of the corresponding image (as would be the case in a pure moiré magnifier), and the parts of the image slices displayed at any one angle appear in combination to reconstitute (a section of) the full corresponding image, just as in a typical lenticular device. However, the shape, extent and location of the region of the device over which that one image is displayed are determined by the moiré mechanism. That is, the moiré interference pattern arising from the combination of the regular focussing element structure array and the array of image slices defines the boundaries of the various regions within which each respective image is displayed.

For comparison, in conventional lenticular devices utilising elongate focussing elements, such as those disclosed in U.S. Pat. No. 4,892,336 A, WO-A-2011/051669, WO-A-2011051670, WO-A-2012/027779, and WO-A-2014/085290, the image slices are arranged parallel to the focusing elements such that, at any one viewing angle, a single one of the image slices in each optical footprint will be directed to the viewer along the whole length of each focusing element, or if there is any cross-talk from neighbouring image slices the extent of this will be constant across the device, such that a single one of the images is displayed (or at least dominates the display) across the device.

In contrast, at any one viewing angle, the presently disclosed device will display at least two images to the viewer simultaneously, in respective regions of the device which are laterally offset from one another, as defined by the moiré interference pattern which arises due to the variation in the pitch with which the image slices are arranged. In the first region of the device, the area of the optical footprint of each focussing structure which is directed to the viewer will coincide with part of an image slice corresponding to the first image (such that a section of the first image is displayed across the first region of the device); whilst at the same time in the second region of the device, the area of the optical footprint of each focussing structure which is directed to the viewer will coincide with part of an image slice corresponding to the second image (such that a section of the second image is displayed across the second region of the device). If three or more sets of image slices are provided (i.e. corresponding the third and optionally further images), the moiré interference pattern will include additional third and optionally further regions in which the respective images are displayed.

The resulting visual effect is new and complex yet memorable and easy to describe, leading to an enhanced security level since the difficult of making a successful counterfeit version is significantly increased relative to conventional devices. In addition, the disclosed security device displays a new, dynamic movement effect when the viewing angle is changed, e.g. by tilting the device. As the viewing angle is changed (about the elongate axes of the focussing element structures), different portions of the underlying image slices are directed to the viewer by the focussing elements, resulting in the moiré interference pattern changing and/or moving in the reference frame of the security element. Since the moiré pattern defines the boundaries of the various regions of the device, these also move and/or change size or shape upon tilting.

It should be noted that as the various regions of the device move upon changing the viewing angle, each will reveal different portions of its respective image, giving rise to a sliding "reveal" visual transformation from one image to the next at any one location on the device. The images themselves do not move relative to the device upon tilting, only the section(s) of each which is displayed.

The pattern in which the regions are arranged will depend on how the pitch varies across the device. As noted above, the pitch variation could take place in just the first direction, just the second direction (i.e. 1-dimensional pitch variations), or in both directions (i.e. a 2-dimensional variation) although it should be appreciated that in all cases, the pitch which undergoes the variation is that between the image slices in the second direction. Hence in one preferred embodiment, each elongate image slice is arranged along a path and the paths of the elongate image slices are parallel to one another across the security device, the pitch between the elongate image slices in the second direction varying across the array in the second direction only. Such an arrangement may for example give rise to a moiré interference pattern comprising a series of approximately straight bands along the first or second directions, or at some angle(s) therebetween. The bands, which will correspond to one or more first regions, may or may not be parallel to one another. The paths of the elongate image slices themselves are preferably rectilinear, curved or formed of multiple rectilinear portions (e.g. "zig-zagged").

In another preferred embodiment, each elongate image slice is arranged along a path and the paths of the elongate image slices are configured such that the distance between adjacent elongate image slices varies across the security device in the first direction, whereby at least some of the image slices are not parallel to one another along at least part of their length, such that the pitch between the elongate image slices in the second direction varies across the array in the first direction. If the variation in pitch is in the first direction only, this will involve the shape of the image slices varying across the array, in order to accommodate the spacing between neighbouring image slices changing in the first direction, which has been found to give first to particularly complex patterns of regions. Hence preferably the array of image elements is configured to include elongate image slices arranged along respective paths of different shape from one another, preferably of varying curvature. For instance, the array of image elements may be configured to include both elongate image slices arranged along respective rectilinear paths and elongate image slices arranged along respective curved paths. Where the neighbouring image slices change shape with respect to one another, the transition from one shape to the next could be sudden, occurring at a well-defined boundary, but more preferably, the transition(s) between elongate image slices with different path shapes is/are gradual across the security device. This gives rise to better continuity of movement of the regions across the device upon tilting.

In further preferred embodiments, the array of image elements is configured such that the pitch between the elongate image slices in the second direction additionally varies across the array in the second direction (i.e. a 2-dimensional pitch variation). For example, the array of image elements may be configured to include elongate image slices arranged on respective rectilinear paths having a non-zero and non-orthogonal angle to one another. For instance the image slices may follow a set of radial paths emanating from a common point of intersection (which may or may not be located within the boundaries of the device).

The manner in which the different image regions move across the device can also be configured in different ways to achieve different visual effects. In some preferred embodiments, the array of image elements is configured such that the pitch between the elongate image slices in the second direction varies across the array in the first and/or second direction(s) continuously across at least part of the security device, preferably across the whole security device. This will typically result in a correspondingly smooth movement effect with the regions of different images appearing to slide across the device upon tilting.

In alternative preferred embodiments, the array of image elements is configured such that the pitch between the elongate image slices in the second direction varies across the array in the first and/or second direction(s) step-wise. This will typically lead to a less smooth movement effect in which the apparent movement of each image may or may not be contiguous. For instance the regions may appear to jump between different locations on the device when tilted.

Optionally, the moiré magnification effect already described above can be exploited further by configuring the pitch variation to give rise to a noticeable three-dimensional effect. Hence, preferably, the array of image elements is configured such that such that the pitch between the elongate image slices in the second direction is different in respective first and second areas of the device in such a way that the apparent depth of the displayed first and second images is different in the respective first and second areas of the device.

Due to the moiré magnification effect, the varying pitch of the image slices will cause the apparent depth (or, analogously, height) of the surface on which the first and second images (and any further images provided in respective regions) are located, to differ across the device. However, whether this variation is noticeable and hence apparent to the viewer will depend on various factors including the degree to which the pitch is varied, and how gradual the variation is. It is preferable (though optional) to configure the pitch variation accordingly to provide such an apparent depth variation since this gives rise to a further three-dimensional visual effect which supplements and enhances the movement effect already described above. Hence, in one area of the device the first and/or second images (depending on whether the "area" coincides with a first region and/or a second region) will preferably appear higher or lower, relative to the plane of the security device, as compared with their apparent "vertical" position (i.e. along the device normal) in another area of the device where the pitch of the image slices is different. In this case, when the device is tilted such that the image regions move (as described above), depending on the extent of the movement, one or more of the regions may transition from one area of the device to another exhibiting a different apparent height. Therefore, the images may appear to move up and down, relative to the plane of the device, as different sections of the images are revealed by the moving regions.

The degree to which the depth variation is visible can be controlled by observing the effect achieved by a sample device and either increasing or decreasing the amount of pitch variation to increase or decrease the three-dimensional effect accordingly. It is preferable to provide a pitch variation of at least 3% between the first and second areas since this has been found to generate a clearly visible difference in depth between the areas.

As in the case of the movement effect, the optional depth variation effect can also be implemented in different ways depending on the configuration of the image slices. In some preferred embodiments, where the array of image elements is configured such that the pitch between the elongate image slices in the second direction varies across the array in the first and/or second direction(s) continuously across at least part of the security device, preferably across the whole security device, the transition in the apparent depth of the displayed first and second images between the first and second areas of the device is gradual. In this way, as the regions of the device displaying the respective images move from one area to another upon changing the viewing angle, the apparent height of the images will change gradually with the regions appearing to move up or down a continuous tilted or curved surface.

In other preferred embodiments, where the array of image elements is configured such that the pitch between the elongate image slices in the second direction varies across the array in the first and/or second direction(s) step-wise, the step-wise variation in pitch is between the first and second areas and the transition in the apparent depth of the displayed first and second images between the first and second areas of the device is discrete. In this way, as the regions of the device displaying the respective images move from one area to another upon changing the viewing angle, the apparent height of the images will change suddenly with the regions appearing to jump up or down from one surface plane to another. Embodiments of this type have been found to exhibit a particularly strong three dimensional appearance with high visual impact.

To increase the complexity of the device still further, a combination of different types of transition between areas could be provided. That is, the boundaries between some areas could be gradual whilst those between other areas could be discrete.

The pitch variation could be configured such that in all areas of the device the image depth appears below the plane of the device and hence the images appear "sunken" in all areas of the device, but to a greater or lesser degree. Conversely, all areas of the device could exhibit image depths above the plane of the device such that the images appear to "float" throughout. However, in a particularly preferred embodiment, in the first area of the device, the pitch of the array of elongate focusing structures in the second direction is greater than the pitch between the elongate image slices in the second direction, whereby in the first area the first and/or second images appear below the plane of the security device, and in the second area of the device, the pitch of the array of elongate focusing structures in the second direction is smaller than the pitch between the elongate image slices in the second direction, whereby in the second area the first and/or second images appear above the plane of the security device. Thus in at least one area the image(s) appear to float whilst simultaneously in at least one other area the image(s) appear sunken. This enhances the 3-dimensional nature of the visual effect.

In a still further enhancement, the various areas of the device could be configured to convey additional information, independent of the content of the two or more images, by virtue of the different image depths displayed in each and/or the transitions between them. Hence, preferably, the variation in pitch of the elongate image slices is configured in accordance with selected indicia such that the apparent depth of the first and second images across the device appears to define a three-dimensional surface having the shape of the selected indicia. Advantageously, the selected indicia could comprise a three-dimensional surface relief, a three-dimensional object, a graphic, a geometric shape or solid, alphanumeric text, a symbol, logo or portrait. It should be noted that the three-dimensional surface defining the indicia may or may not be a single continuous surface. This may be preferred if the indicia represents an object such as a solid sphere but in other cases the indicia could be formed of two or more surfaces which are each two-dimensional but exhibit different relative image heights.

It should be noted that each image slice may or may not be contiguous along its path. In some preferred embodiments, each image slice comprises a corresponding elongate image element (straight, curved or made of multiple straight portions) extending along the path such that the elongate image slice follows the path in a continuous manner (as opposed to discrete or step-wise). In this case the image slice will be contiguous. However, in other preferred embodiments, each image slice comprises a set of at least two image elements positioned along the path such that the elongate image slice follows the path in a discrete and/or stepwise manner. The at least two image elements forming the set may contact one another or could be spaced from one another (optionally by image elements forming parts of other image slices, from different images), in which case the image slice will not be contiguous. Since the position of the image slice will change in steps rather than gradually along the first direction, the apparent motion of the regions exhibited upon tilting may appear to take place in discrete stages rather than as one smooth motion. This may be desirable depending on the design of the device.

Where each image slice comprises a set of at least two image elements, advantageously the array of image elements are arranged on a grid, preferably an orthogonal grid, the axes of the grid being non-parallel with the paths of the image slices. For instance, a standard orthogonal grid of square, rectangular or hexagonal image elements could be utilised. Preferably, the axes of the grid are parallel to the first and second directions. Advantageously, the image elements are elongate, preferably in the first direction.

The shape of the image slice path (and hence the moiré interference pattern) can be determined by the positioning of the image elements forming the set or analogously by the selection of image elements from the array to form the set representing one image slice. Hence in some preferred examples, the spacing in the first and second directions between each one of the set of image elements and the next one of the set of image elements is constant along the first direction. This will result in a rectilinear path of constant angle θ. In other preferred embodiments, the spacing in the first and/or second directions between each one of the set of image elements and the next one of the set of image elements varies along the first direction. This can be used to form a curved path or a path with multiple straight segments, as desired in order to achieve different patterns of regions as described above.

In some embodiments, the arrangement of the image slices and the dimensions of the focusing elements may be such that only one first region displaying the first image will be exhibited by the device at any one time, this first region moving relative to the device upon tilting, or the same may be the case for a single second region displaying the second image. (Typically if there is a single first region there will be at least two second regions since these will bound the first region on both sides, and vice versa). However, preferably, the array of image elements is configured such that the first image is displayed across at least two first regions of the device, and simultaneously, the second image is displayed across at least two second regions of the device which are laterally offset from the first regions. This not only enhances the complexity and hence security level of the device but can also be utilised to exhibit more of the first and second images across the device since multiple sections of each image will be displayed at any one time. The provision of multiple first and second regions can be achieved through design of the moiré interference pattern arising from the pitch variation in the image array. Preferably the first and second regions of the device alternate across the device in the first and/or second directions. If three or more images are provided, which will displayed in corresponding first, second, third and possibly further regions of the device, typically those further regions will also form part of a repeating pattern of regions across the device. Throughout this specification, the term "elongate focussing structure" should be understood as encompassing both a single, elongate focussing element and (alternatively) a set of at least two focusing elements arranged to collectively form an elongate focussing structure (but which need not, individually, be elongate). Hence, in some preferred embodiments, each elongate focusing structure comprises an elongate focusing element, preferably a cylindrical focusing element. Thus the array of elongate focussing structures could be a regular array of linear focussing elements with periodicity in one dimension only (parallel to the second direction).

However in other preferred implementations, each elongate focusing structure comprises a plurality of focusing elements, preferably spherical or aspherical focusing elements, arranged such that the centre point of each focusing element is aligned along a straight line in the first direction (which in practice will correspond to the centre line of the optical footprint). In this case, for example, the focusing elements could be arranged in an orthogonal array (square or rectangular) or in a hexagonal array. Hence the array of elongate focussing structures may have a two-dimensional periodicity. Where each elongate focusing structure comprises a plurality of elements, preferably those elements substantially abut one another along the first direction or at least have no intervening focusing elements with centre points which are not on the same straight line.

Forming each elongate focussing element as a line of focusing elements such that the array has two-dimensional periodicity has a number of potential benefits.

Firstly, such implementations have been found to exhibit good visual effects over a larger range of viewing angles (i.e. lower viewing angle dependence) as compared with devices using cylindrical lenses. Secondly, the use of such arrays improves the design freedom since different "first directions" can be defined relative to the same array in different regions of the device. For example, in an orthogonal grid of elements either of the two orthogonal axes could be used as the first direction so in a first part of the device the pitch of the image slices along one orthogonal direction (locally acting as the second direction) could be varied, and in a second part of the device the pitch of the image slices in the other of the orthogonal axes (locally acting as the second direction) could be varied. In this way the two parts of the device will exhibit different effects (one appearing active when tilting occurs in a first direction, whilst the other is static, and vice versa when tilting occurs in an orthogonal direction), achieved through design of the image array only and not requiring any distinction between the focusing elements in each part of the device. This also avoids the need for any translational registration between the image array and the focussing elements.

In all cases, the focusing elements making up the focusing structure array are preferably lenses or mirrors. The periodicity of the focusing structure array in the second direction (and optionally in the first direction) and therefore maximum width of the individual focusing elements in the second direction is related to the device thickness and is preferably in the range 5-200 microns, still preferably 10 to 70 microns, most preferably 20-40 microns. The focusing elements can be formed in various ways, but are preferably made via a process of thermal embossing or cast-cure replication. Alternatively, printed focusing elements could be employed as described in U.S. Pat. No. 6,856,462 B. If the focusing elements are mirrors, a reflective layer may also be applied to the focussing surface.

In some preferred embodiments, the image elements are defined by inks. Thus, the image elements can be simply printed onto a substrate although it is also possible to define the image elements using a relief structure or by partially demetallising a metal layer to form a pattern. Such methods enable much thinner devices to be constructed which is particularly beneficial when used with security documents.

Suitable relief structures can be formed by embossing or cast-curing into or onto a substrate. Of the two processes mentioned, cast-curing provides higher fidelity of replication. A variety of different relief structures can be used as will described in more detail below. However, the image elements could be created by embossing/cast-curing the images as diffraction grating structures. Differing parts of the image could be differentiated by the use of differing pitches or different orientations of grating providing regions with a different diffractive colour. Alternative (and/or additional differentiating) image structures are anti-reflection structures such as moth-eye (see for example WO-A-2005/106601), zero-order diffraction structures, stepped surface relief optical structures known as Aztec structures (see for example WO-A-2005/115119) or simple scattering structures. For most applications, these structures could be partially or fully metallised to enhance brightness and contrast.

Examples of preferred techniques for forming the image elements in a metal later are disclosed in our British patent application no. 1510073.8. Particularly good results have been achieved through the use of a patterning roller (or other tool) carrying a mask defining the desired pattern, as described therein. A suitable photosensitive resist material is applied to a metal layer on a substrate and the exposed in a continuous manner to appropriate radiation through the patterned mask. Subsequent etching transfers the pattern to the metal layer, thereby defining the image elements.

Typically, the width of each image element may be less than 50 microns, preferably less than 40 microns, more preferably less than 20 microns, most preferably in the range 5-10 microns.

Any number of image slices per optical footprint (at least 2) could be provided and this will depend on factors including the number of different images which it is desired to present. In theory there is no upper limit as to the number of image slices which could be included, but, in practice, the image resolution will be reduced as the number of image slices increases since an ever-decreasing proportion of the unit cell area (and hence of the device as a whole) will be available for display of each respective image. Also, in practical implementations the number of image elements which can be formed in one optical footprint will be limited by the resolution at which the image elements can be formed.

For example if using an ink-based printing method to form the image elements with a minimum print dimension of 15 microns then for a 30 micron wide footprint, a maximum of 2 image slices can be provided across the width of the footprint. Supposing however the minimum print dimension can be reduced to the level of around 1 micron (e.g. through the use of relief structures or demetallisation rather than printing to form the image elements) then the number of image elements may more likely be constrained by the desired visual effect and the size of image data file that can be managed during the origination of the print tool. The type of design effects which require a high number of matrix positions would include animation effects and more especially continuous and horizontal parallax effects.

Preferably, the array of image elements is located approximately in the focal plane of the focusing structures. Typical thicknesses of security devices according to the invention are 5 to 200 microns, more preferably 10 to 70 microns, with lens heights of 1 to 70 microns, more preferably 5 to 25 microns. For example, devices with thicknesses in the range 50 to 200 microns may be suitable for use in structures such as over-laminates in cards such as drivers licenses and other forms of identity document, as well as in other structures such as high security labels. Suitable maximum image element widths (related to the device thickness) are accordingly 25 to 50 microns respectively. Devices with thicknesses in the range 65 to 75 microns may be suitable for devices located across windowed and half-windowed areas of polymer banknotes for example. The corresponding maximum image element widths are accordingly circa 30 to 37 microns respectively. Devices with thicknesses of up to 35 microns may be suitable for application to documents such as paper banknotes in the form of slices, patches or security threads, and also devices applied on to polymer banknotes where both the lenses and the image elements are located on the same side of the document substrate.

If the image elements are formed as a relief structure, the relief depth depends on the method used to form the relief. Where the relief is provided by a diffractive grating the depth would typically be in the range 0.05-1 μm and where a coarser non-diffractive relief structure is used, the relief depth is preferably in the range 0.5 to 10 μm and even more preferably 1 to 5 μm.

Embodiments of the invention can be implemented without registering the focusing elements to the image elements along the first or second direction.

However, such registration is preferred in certain embodiments in order that the resulting visual effect can be better controlled. In particular, registration enables control over the location of each region along the device at each viewing angle.

Each respective image which the device is configured to display could take any form. In some preferred embodiments, one of the first and second images (and preferably not all of the images) is a uniform colour (i.e. a solid, unpatterned colour block) or is blank (e.g. transparent). This can provide a clear contrast when used in combination with one or more images of greater complexity: for example the uniform image can appear as a cover which slides across the device to reveal or hide a second image, or if left blank or transparent the second image will appear to transition to blank, i.e. appear and disappear at any one location on the device. More complex images which may be used to form at least one (and preferably each) of the first and second images include any of: a letter, number, symbol, character, logo, portrait or graphic. In particularly preferred examples, one or more (preferably all) of the images may be configured to co-operate visually with the above-described motion effect. For example, if the motion of the regions is configured to relate to some point or line inside the device, e.g. by emanating from the point or line, one or more of the images may be symmetrical about that location or display an appropriate indicia at that location. Such designs help to visually link the motion effect to the image(s) displayed by the device, which increases the integration of the security effects.

The security level of the device can be further increased by incorporating one or more additional functional materials into the device, such as a fluorescent, phosphorescent or luminescent substance. In further examples, the device may also comprise a magnetic layer.

Also provided is a security device assembly, comprising at least two security devices each as described above, wherein the first direction along which the elongate focusing structures are aligned in each security device is different, preferably orthogonal to one another. In this way, different ones of the devices will be configured to exhibit the above-described effects upon tilting in different directions. As mentioned above this can be achieved using a two-dimensional grid of focusing elements which is continuous across both devices. However in other cases each device could be provided with a different array of focussing elements (e.g. different in terms of orientation, pitch and/or focussing element type). The at least two devices preferably abut one another although could be spaced from one another depending on the design.

Preferably, the security device or security device assembly is formed as a security thread, strip, foil, insert, label or patch. Such devices can be applied to or incorporated into articles such as documents of value using well known techniques, including as a windowed thread, or as a strip applied to a surface of a document (optionally over an aperture or other transparent region in the document). The document could for instance be a conventional, paper-type banknote, or a polymer banknote, or a hybrid paper/polymer banknote. Preferably, the article is selected from banknotes, cheques, passports, identity cards, certificates of authenticity, fiscal stamps and other documents for securing value or personal identity.

Alternatively, such articles can be provided with integrally formed security devices of the sort described above. Thus in preferred embodiments, the article (e.g. a polymer banknote) comprises a substrate with a transparent portion, on opposite sides of which the focusing elements and elongate image elements respectively are provided.

The invention further provides a method of manufacturing a security device comprising:

providing an array of elongate focusing structures, the elongate axes of which are aligned along a first direction, the elongate focusing structures being arranged parallel to one another periodically along a second direction which is orthogonal to the first direction, each elongate focusing structure having an optical footprint of which different elongate strips will be directed to the viewer in dependence on the viewing angle, the centre line of each optical footprint being parallel with the first direction; and overlapping an array of image elements overlapping the array of elongate focusing structures, the array of image elements representing elongate image slices of at least two respective images, each image slice comprising one or more image elements, and at least one image slice of each respective image being located at least partially in the optical footprint of each elongate focusing structure;

wherein the array of image elements is configured such that the pitch between the elongate image slices of each respective image in the second direction varies across the array in the first and/or second direction(s);

whereby, at any one viewing angle, in a first region of the device the elongate focussing structures direct portions of first image slices corresponding to a first image to the viewer such that the first image is displayed across the first region of the device, and simultaneously, in a second region of the device which is laterally offset from the first region in the first and/or second direction(s), the elongate focussing structures direct portions of second image slices corresponding to a second image to the viewer such that the second image is displayed across the second region of the device, the positions of the first and second regions relative to the security device depending on the viewing angle.

The result is a security device having the attendant benefits described above. The method can be adapted to provide the device with any of the features described previously.

Figure 6A:
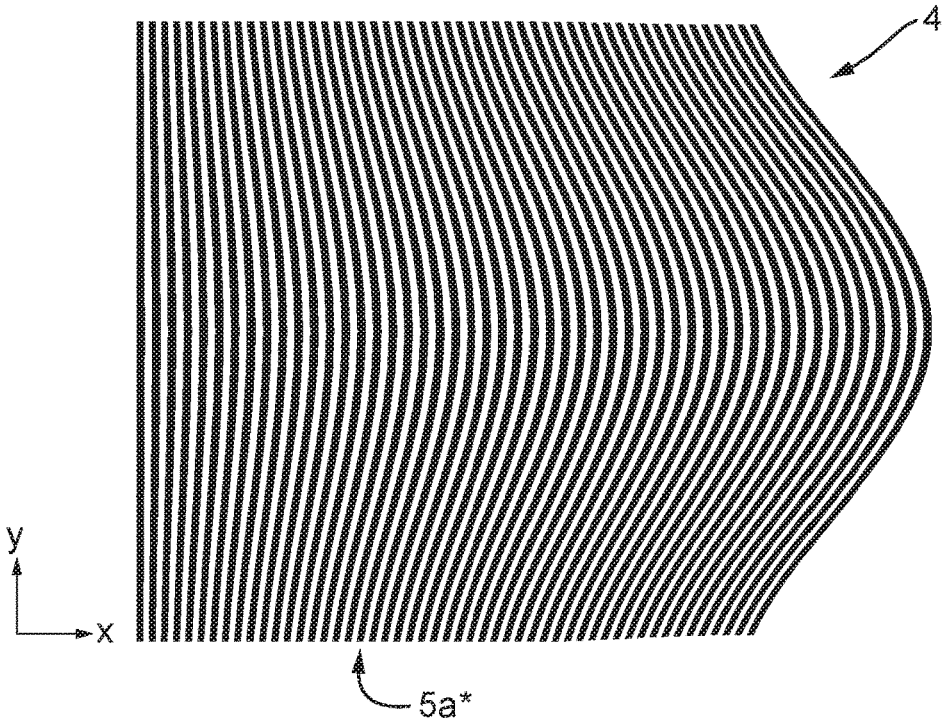
Figure 6B:
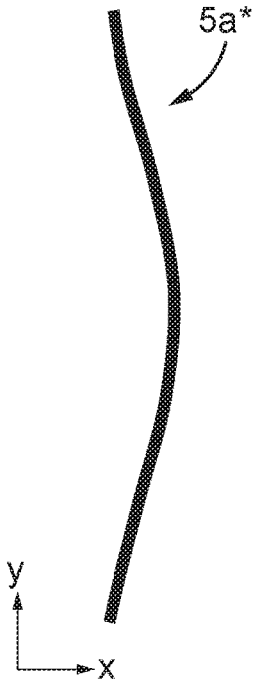
Figure 6C:
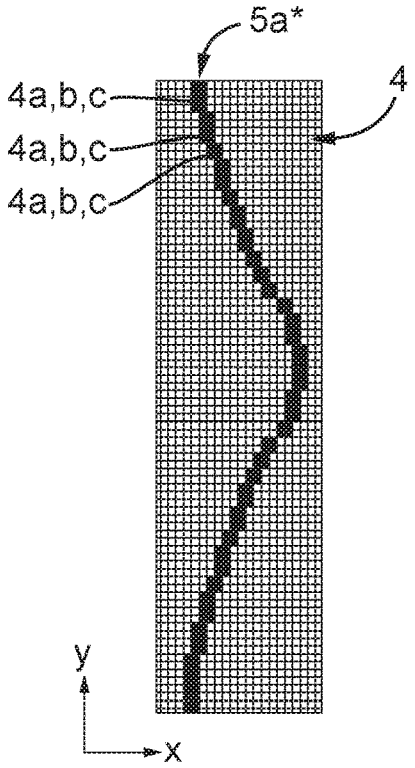
Figure 7:
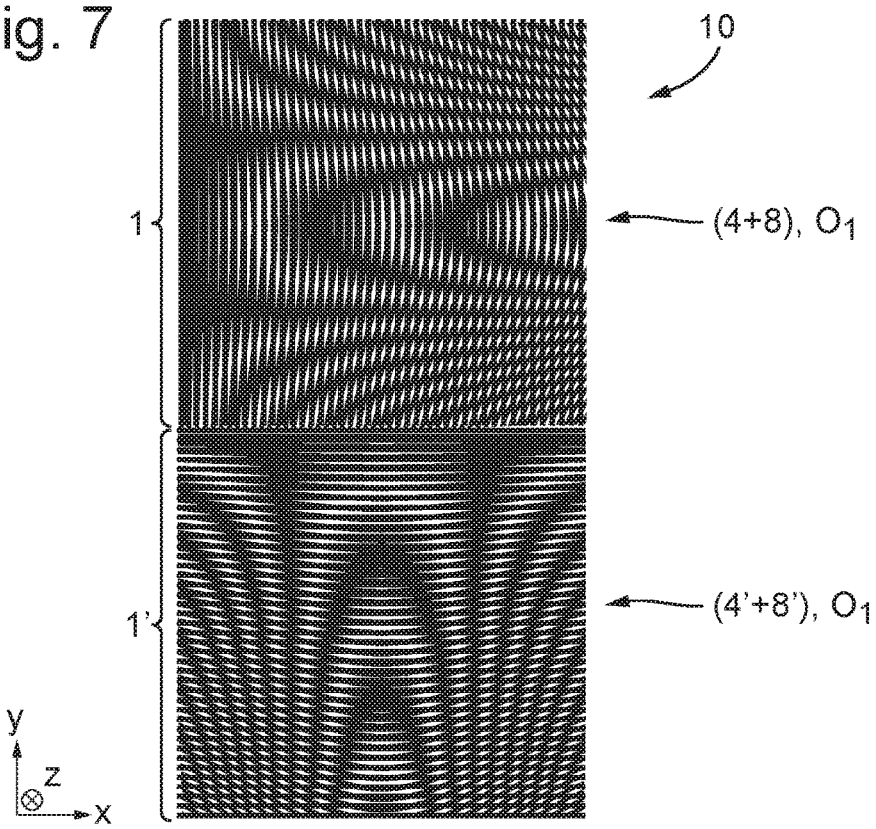
Figure 8A:
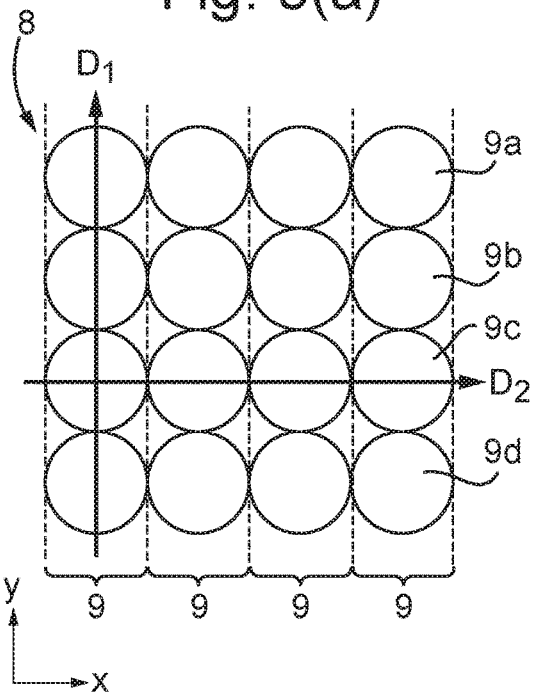
Figure 8B:
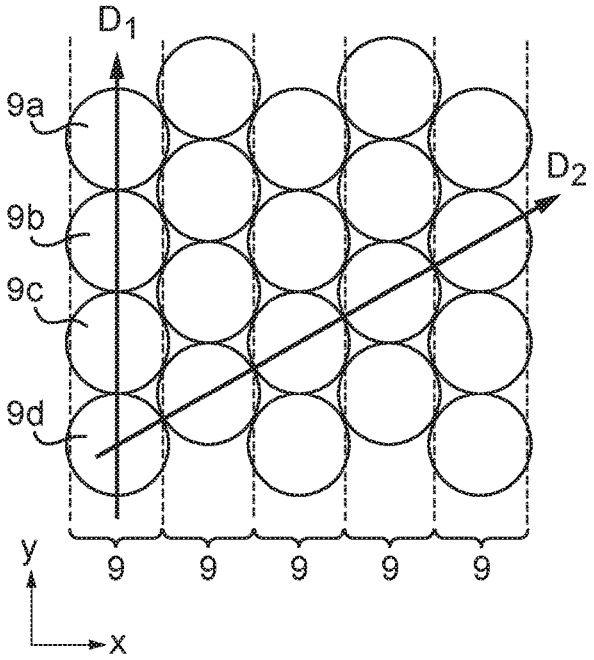
Figure 10A:
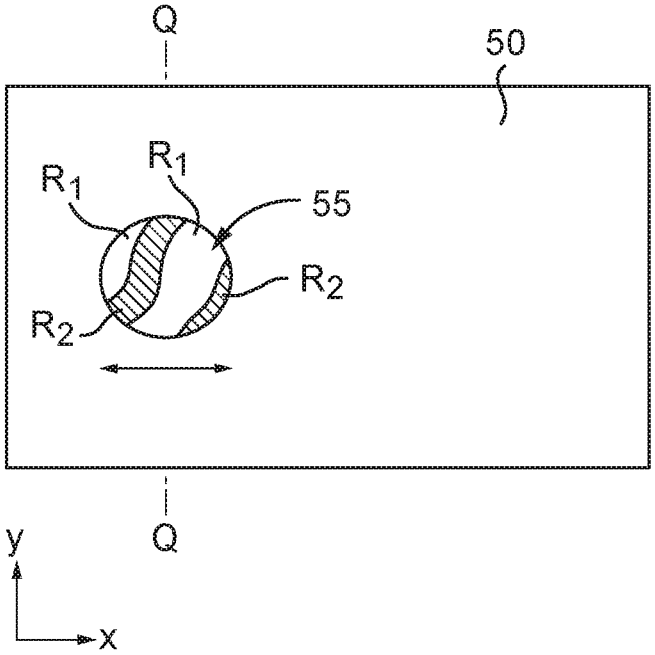
Figure 10B:
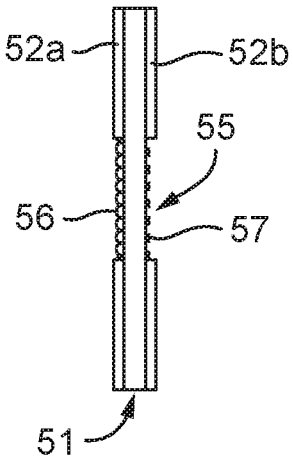
Figure 11A:
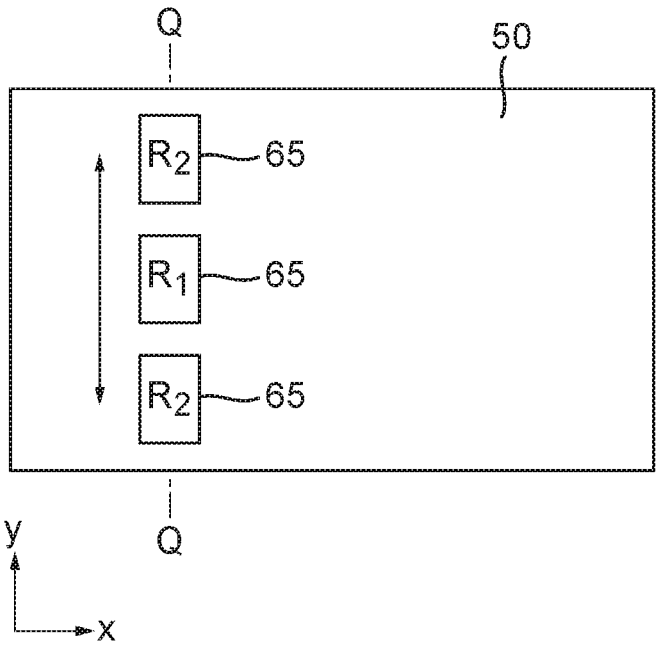
Figure 11B:
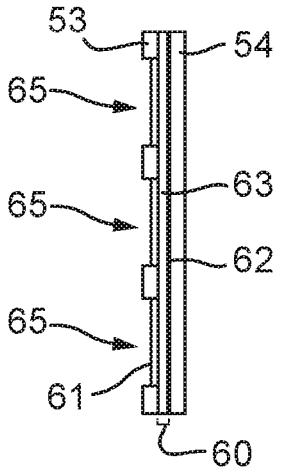
Figure 12A:
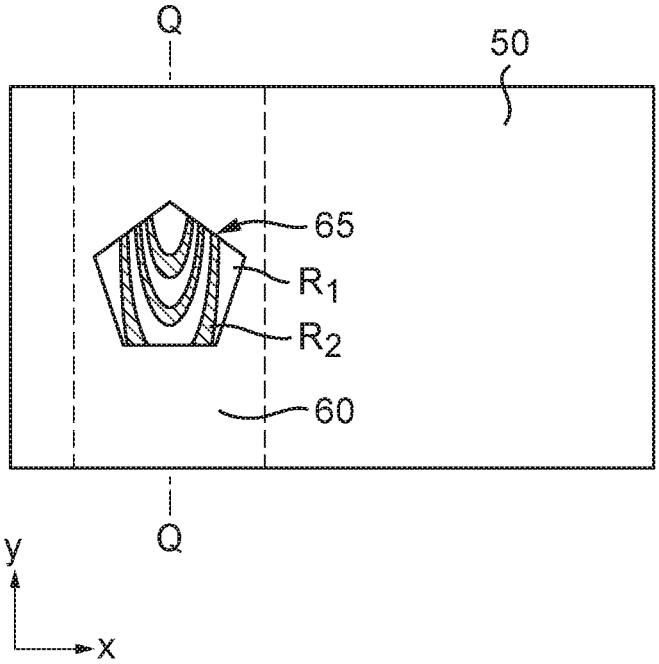
Figure 12B:
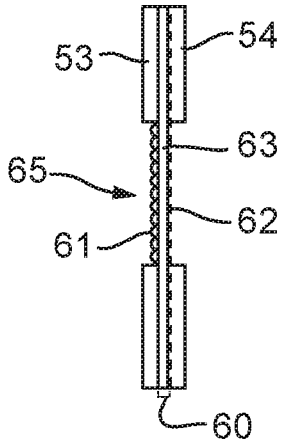
Figure 13A:
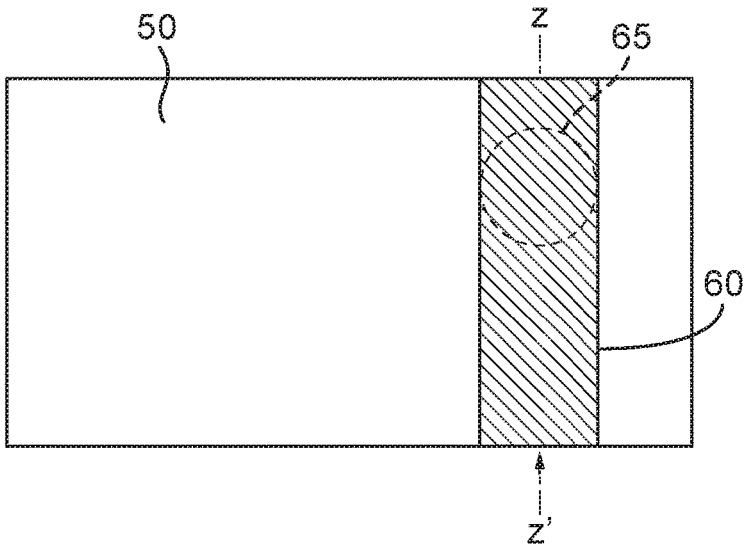
Figure 13C:
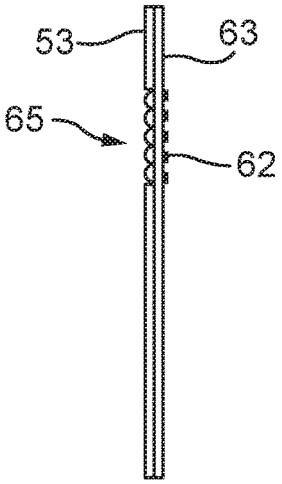
Figure 13B:
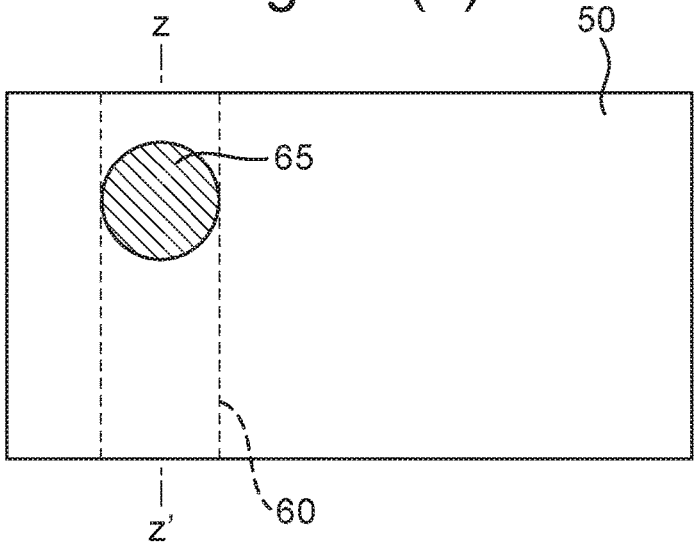

Examples of security devices will now be described and contrasted with conventional devices, with reference to the accompanying drawings, in which:

FIG. 1 schematically depicts a comparative example of a conventional security device: FIG. 1(*a*) showing a schematic perspective view of the security device; FIG. 1(*b*) showing a cross-section through the security device; and FIGS. 1(*c*) and (*d*) showing two exemplary images which may be displayed by the device at different viewing angles;

FIG. 2 schematically depicts a first embodiment of a security device in accordance with the present invention: FIG. 2(*a*) depicting an exemplary focussing element array of the security device in plan view; FIG. 2(*b*) depicting an exemplary image element array in plan view; FIG. 2(*c*) showing an exemplary moiré interference pattern formed when the focussing element array of FIG. 2(*a*) overlays the image element array of FIG. 2(*b*) at a first viewing angle; FIG. 2(*d*) illustrates the appearance of the security device when observed at the first viewing angle; FIG. 2(*e*) illustrates the appearance of the security device when observed at a second viewing angle; and FIG. 2(*f*) is a plot showing the apparent height h of the images displayed by the security device along the line X-X';

FIG. 3 schematically depicts a second embodiment of a security device in accordance with the present invention: FIG. 3(*a*) depicting an exemplary focussing element array of the security device in plan view; FIG. 3(*b*) depicting an exemplary image element array in plan view; FIG. 3(*c*) showing an exemplary moiré interference pattern formed when the focussing element array of FIG. 3(*a*) overlays the image element array of FIG. 3(*b*) at a first viewing angle; FIG. 3(*d*) illustrates the appearance of the security device when observed at the first viewing angle; FIG. 3(*e*) illustrates the appearance of the security device when observed at a second viewing angle; and FIG. 3(*f*) is a plot showing the apparent height h of the images displayed by the security device along the line Y-Y';

FIG. 4 schematically depicts a third embodiment of a security device in accordance with the present invention: FIG. 4(*a*) depicting an exemplary focussing element array of the security device in plan view; FIG. 4(*b*) depicting an exemplary image element array in plan view; FIG. 4(*c*) showing an exemplary moiré interference pattern formed when the focussing element array of FIG. 4(*a*) overlays the image element array of FIG. 4(*b*) at a first viewing angle; FIG. 4(*d*) illustrates the appearance of the security device when observed at the first viewing angle; FIG. 4(*e*) illustrates the appearance of the security device when observed at a second viewing angle; FIG. 4(*f*) is a plot showing the apparent height h of the images displayed by the security device along the line X-X'; and FIG. 4(*g*) is a plot showing the apparent height h of the images displayed by the security device along the line Y'-Y;

FIG. 5 schematically depicts a fourth embodiment of a security device in accordance with the present invention: FIG. 5(*a*) depicting an exemplary focussing element array of the security device in plan view; FIG. 5(*b*) depicting an exemplary image element array in plan view; FIG. 5(*c*) showing an exemplary moiré interference pattern formed when the focussing element array of FIG. 5(*a*) overlays the image element array of FIG. 5(*b*) at a first viewing angle; FIG. 5(*d*) illustrates the appearance of the security device when observed at the first viewing angle; FIG. 5(*e*) illustrates the appearance of the security device when observed at a second viewing angle; FIG. 5(*f*) is a plot showing the apparent height h of the images displayed by the security device along the line X-X'; and FIG. 5(*g*) is a plot showing the apparent height h of the images displayed by the security device along the line Y'-Y;

FIG. 6(*a*) illustrates an exemplary image element array suitable for use in embodiments of the invention; FIG. 6(*b*) shows a single image slice taken from the array of FIG. 6(*a*) formed as a continuous image element; and FIG. 6(*c*) shows the same image slice formed from a set of image elements;

FIG. 7 schematically depicts an embodiment of a security device assembly in plan view at one viewing angle;

FIGS. 8*a* and 8*b* show two alternative examples of arrays of elongate focussing structures which may be utilised in any embodiment of the security devices disclosed herein, in plan view;

FIGS. 9*a* to 9*i* illustrate different examples of relief structures which may be used to define image elements in accordance with embodiments of the present invention;

FIGS. 10, 11 and 12 show three exemplary articles carrying security devices in accordance with embodiments of the present invention, a) in plan view and b) in cross-section; and FIG. 13 illustrates a further embodiment of an article carrying a security device in accordance with embodiments of the present invention, a) in front view, b) in back view and c) in cross-section.

A comparative example of a lenticular device 1 is shown in FIG. 1 in order to illustrate certain principles of operation. FIG. 1(*a*) shows the device 1 in a perspective view and it will be seen that an array 8 of focussing element structures, here in the form of cylindrical lenses 9, is arranged on a transparent substrate 2. An image element array 4 is provided on the opposite side of substrate 2 underlying (and overlapping with) the cylindrical lens array 8. Alternatively the image element array 4 could be located on the same surface of the substrate 2 as the lenses, directly under the lenses. Each cylindrical lens 9 has a corresponding optical footprint which is the area of the image element array 4 which can be viewed via the corresponding lens 9. In this example, the image element array 2 comprises a series of image slices, of which two slices 5*a*, 5*b* are provided in (and fill) each optical footprint.

The image slices 5*a* each correspond to strips taken from a first image $I_A$ whilst the image slices 5*b* each correspond to strips of a second image $I_B$. Thus, the size and shape of each first image slice 5*a* is substantially identical (being elongate and of width equal to half the optical footprint), but their information content will likely differ from one first image slice 5*a* to the next (unless the first image $I_A$ is a uniform, solid colour block). The same applies to the second image slices 5*b*. The overall pattern of image slices is a line pattern, the elongate direction of the lines lying substantially parallel to the axial direction of the focussing elements 9, which here is along the y-axis and may be referred to below as the "first direction" of the device. For reference, the orthogonal direction (x axis) may be referred to as the second direction of the device.

As shown best in the cross-section of FIG. 1(*b*), the image element array 4 and the focussing element array have substantially the same periodicity as one another in the x-axis direction, such that one first image slice 5*a* and one second image slice 5*b* lies under each lens 9. The pitch P of the lens array 8 and of the image element array 4 is substantially equal and is constant across the whole device. In this example, the image array 4 is registered to the lens array 8 in the x-axis direction (i.e. in the arrays' direction of periodicity) such that a first pattern element $P_1$ lies under the left half of each lens and a second pattern element $P_2$ lies under the right half. However, registration between the lens array 8 and the image array in the periodic dimension is not essential.

When the device is viewed by a first observer $O_1$ from a first viewing angle, as shown in FIG. 1(*b*) each lens 9 will direct light from the underlying first image slice 5*a* to the observer, with the result that the device as a whole appears to display the appearance of the first image $I_A$, which in this case is a graphic illustrating a landscape scene as shown in FIG. 1(*c*). The full image $I_A$ is reconstructed by the observer $O_1$ from the first image slices 5*a* directed to him by the lens array 8. When the device is tilted so that it is viewed by second observer $O_2$ from a second viewing angle, now each lens 9 directs light from the second image slices 5*b* to the observer. As such the whole device will now appear to display a second image $I_B$, which in this example is a uniform block colour as shown in FIG. 1(*d*), although it could comprise any alternative image. Hence, as the security device is tilted back and forth between the positions of observer $O_1$ and observer $O_2$, the appearance of the whole device switches between image $I_1$ and image $I_2$.

A first embodiment of a security device in accordance with the present invention will now be described with reference to FIG. 2. The security device 1 is of substantially the same physical construction as that of the security device 1 shown in FIG. 1(*a*), comprising an array 8 of cylindrical lenses 9 on a transparent substrate 2 having an image element array 4 located on the opposite side (or alternatively directly under the lenses 9). The lens array 8 is shown schematically in FIG. 2(*a*) where the black lines represent the central, long axis of each lens 9. The lens 9 are elongate along the first direction (y-axis) and periodic in the second direction (x-axis), with a uniform pitch of P*. As before, the image element array 4 comprises a series of elongate image slices 5*a*, 5*b* which correspond to respective first and second images $I_A$ and $I_B$. The image element array 4 is shown schematically in FIG. 2(*b*) in which each black line represents a first image slice 5*a* and each intervening white line represents a second image slice 5*b*. It should be appreciated that in practice the content of each image slice will depend on the image it is taken from and therefore will typically vary along its length (and from one image slice to the next). For clarity, this is not shown in representations of the image element array 4 in the Figures which should be taken as indicative of the shape, size and position of the image slices 5, rather than their information content.

As in the conventional device shown in FIG. 1, the image slices 5*a*, 5*b* are rectilinear (straight) and lie parallel to one another and to the long axes of the lenses 9 (i.e. along the y-axis). However, unlike the comparative example, here the pitch between each set of image slices (i.e. the spacing between neighbouring first image slices 5*a* and between neighbouring second image slices 5*b*) in the x-axis direction is not uniform across the device but rather varies from one area to another. In a first area 6*a* (which extends along the full length of the device in the y-axis direction but only across the labelled portion in the x-axis direction), the image slices 5*a*, 5*b* are arranged with a first pitch Pa. Along the x-axis, in an adjacent second area 6*b*, the pitch is increased to Pb by an incremental amount, and then increased by further increments in each of third, fourth and fifth areas 6*c*, 6*d* and 6*e* to a maximum value of Pe.

It should be noted that any banding or other interference effect appearing in FIGS. 2(*a*) and (*b*) is unintentional, being an artefact of the printing of the Figures, and is not present in practice.

When the lens array 8 and image element array 4 are combined (e.g. as shown in FIG. 1(*a*)), the varying pitch of the image slices gives rise to moiré interference between the two arrays. An example of the resulting interference pattern, as would be observed from a first viewing angle by observer $O_1$, is shown in FIG. 2(*c*). Due to the varying pitch of the image slices 5*a*, 5*b*, in some regions of the device the lenses 9 will direct light from first image slices 5*a* to the viewer, whilst simultaneously in other regions of the device the lenses 9 will direct light from second image slices 5*b* to the viewer. For example, as shown in FIG. 1(*c*), in first region(s) $R_1$, the centre lines of the lenses 9 substantially coincide with the first image elements 5*a*, with the result that when viewed approximately on the normal to the device, the first image $I_A$ dominates the appearance of that region $R_1$. At the same time, in second region(s) $R_2$, the centre lines of the lenses 9 coincide with second image elements 5*b*, with the result that the second image $I_B$ is displayed here.

FIG. 2(*d*) schematically illustrates the resulting appearance of the device (from the same viewing angle as FIG. 1(*c*)) using exemplary first and second images $I_A$ and $I_B$ which are the same as those used in the comparative example of FIG. 1. It will be appreciated that here the boundaries of each region $R_1$, $R_2$ are shown in a simplified form for clarity: in practice these will follow the dark and light "bands" of the interference pattern shown in FIG. 2(*c*). Thus, in each first region $R_1$, a section of the first image $I_A$ is displayed, whilst in each second region $R_2$, a section of the second image $I_B$ is displayed. It should be appreciated that whilst in many cases, the interference pattern will give rise to a plurality of first regions $R_1$ and a plurality of second regions $R_2$, typically alternating with one another across the device (as in the example shown), this is not essential. In some embodiments, a single first region $R_1$ and/or a single second region $R_2$ may arise.

As the viewing angle is changed, the portion of the optical footprint under each lens 9 which is directed to the viewer will also change, as explained with respect to FIG. 1(*b*) above. This manifests itself as a change in the interference pattern generated by the two arrays 4 and 8 in combination with one another. In the present case, upon tilting of the device about the y-axis, the "bands" of the interference pattern will appear to move along the x-axis direction and may also undergo changes in their width in the same direction. The result is that the first and second regions $R_1$, $R_2$, appear to move across the device, revealing different sections of their respective images as they do so. To illustrate this, FIG. 2(*e*) shows the appearance of the device from a viewing angle different to that of FIGS. 2(*c*) and (*d*), involving a rotation about the y-axis. It will be seen that all of the regions have shifted to the left (i.e. in the negative x-axis direction), such that different parts of the first and second images are revealed, (This is less apparent in the case of the second image $I_B$ than the first image $I_A$ due to its consisting of a uniform colour block with the result that all of its sections appear the same).

What is not illustrated in FIGS. 2(*d*) and (*e*) is that the apparent height (or analogously, depth) of the images in the z-axis direction is not uniform across the device in this embodiment. That is, the images $I_A$ and $I_B$ do not appear to sit on a flat plane parallel to the plane of the device (which plane may be referred to for convenience as "horizontal"). Rather, the vertical position—i.e. height above the device surface or depth beneath it—at which the images are visualised varies from one area 6 of the device to another, as a result of the pitch variation in the image element array 4, described above. Whilst this arises due to the moiré magnification of the elongate image slices, caused by the mismatch in pitch between the lens array 8 and the image element array 4, and moreover due to the change in the amount of pitch mis-match across the device, it should be noted that not all embodiments of the invention need display such a depth variation (an example is given below in relation to FIG. 4). The degree to which this is apparent to a viewer will depend on the specific configuration of the image slices. Nonetheless, providing a difference in the apparent height of the different areas of the device, as in the present embodiment, is preferred in order to enhance the visual effect of the device. For the avoidance of doubt it should be noted that the terms "height" and "depth" are used in this context interchangeably throughout this description, since an image's "height" is the same as its "depth" but with a negative value. Both refer to the vertical position v of the image along the z-axis (where the device surface lies in the x-y plane).

The degree of magnification achieved by moiré magnification is defined by the expressions derived in "The Moiré magnifier", M. Hutley, R Hunt, R Stevens & P Savander, Pure Appl. Opt. 3 (1994) pp. 133-142. To summarise the pertinent parts of this expression, suppose in area 6*a* of the device the image slice pitch is Pa and the lens array pitch is P* (both pitches lying in the x-axis direction), then the magnification M is given by:

$$M=Pa/\mathrm{SQRT}[(P^*\cos(\mathrm{Theta})-Pa)^2-(P^*\sin(\mathrm{Theta}))^2]$$

where, Theta equals angle of rotation between the two arrays. For the case where Pa≠P* and where Theta is very small such that cos(Theta)≈1 and sin(Theta)≈0:

$$M=Pa/(P^*-Pa)=S/(1-S) \quad (1)$$

Where S=Pa/P*

However for large M>>10 then S must≈unity and thus $$M\approx 1/(1-S)$$

The vertical position v of the synthetic image (i.e. the pattern defining regions $R_1$, $R_2$, as shown in FIG. 2(*c*)) relative to the surface plane derives from the familiar lens equation relating magnification of an image located a distance v from the plane of lens of focal length f, this being:

$$M=v/f-1 \quad (2)$$

Or, since typically v/f<<1

$$M\approx v/f$$

Thus the vertical position v of the synthetically magnified image=M.f

For example, if the lens array 8 were comprised of lenses 9 with a focal length f of 40 microns (0.04 mm), and both the lenses 9 and the supporting substrate 2 were comprised of materials with refractive index n of 1.5, then it follows that the base diameter (width) D of the lenses 9 will constrained by the expression $$D \leq f \cdot 2(n-1) \text{ and therefore } D \leq 0.04.2(1.5-1), \text{ giving } D \leq 0.04 \text{ mm.}$$

We might then choose a value for D of 0.035 mm and a lens pitch P* of 0.04 mm (along the x axis), resulting in a lens array with a f/# number close to unity with reasonable close packing (inter lens gap 5 microns). In order to obtain an image surface in area 6*a* which appears to sit 2 mm below the device surface (i.e. v=2 mm), the necessary pitch Pa of the image slices 5*a* can be calculated as follows:

$$\text{Given } M=v/f, \text{ substituting the above values for } v \text{ and } f, \text{ then } M=2/0.04=50.$$

Therefore since M=Pa/(P*−Pa)=50, it follows that 50(P*−Pa)=Pa, giving Pa=P*.(50/51). Substituting P*=0.04 mm, we obtain Pa=0.0392 mm as the pitch in area 6*a* needed to give rise to a vertical position v of the image surface of 2 mm.

In a second example, suppose we wish the images in a second area 6*b* of the device to appear on a flat image plane 6 mm behind the plane of the device.

Now, M=6/0.04=150 and thus 150(P*−Pb)=Pb, giving Pb=P*.(150/151)=0.0397 mm. Hence the pitch Pb of the image slices 5*a* in the second area 6*b* is greater than that in the first area 6*a* (as shown in FIG. 2(*b*)) but since this results in a reduction in the pitch mismatch (P*−Pb), the magnification level M is increased and hence so is the apparent image depth. This is illustrated in FIG. 2(*f*) which is a plot of the vertical position v at which the images appear to sit, across the line X-X' shown in FIGS. 2(*d*) and 2(*e*). The surface plane of the device is indicated by $v_0$.

In the third area 6*c* of the device, the pitch Pc of the image slices is arranged to be substantially equal to that of the lens array, P*. As such there is no magnification and the image plane coincides with the device plane, as shown in FIG. 2(*f*).

In the fourth and fifth areas 6*d* and 6*e* of the device, the pitch of the image slices 5*a* is increased still further, to Pd and then Pe respectively, such that it is now greater than the pitch of the lenses P*. Here the magnified image will be a real inverted image and thus the sign of the magnification will be negative (which follows from assigning a negative value for the image depth v in the previous expression for magnification).

Hence, to achieve an image surface height of 6 mm above the device plane in the fourth area 6*d*:

$$M=-6/0.04=-150 \text{ and thus } -150(P^*-Pd)=Pd, \text{ giving } Pd=(150/149)P^*=0.0403 \text{ mm.}$$

Similarly, in the fifth area 6*e*, to achieve an image surface height of 2 mm above the device plane:

$$M=-2/0.04=-50 \text{ and thus } -50(P^*-Pd)=Pd, \text{ giving } Pd=(50/49)P^*=0.0408 \text{ mm.}$$

Hence we see that for the image plane to be located in front of the surface plane $v_0$ (i.e appearing to float) the image slice array 4 must have a pitch larger than the lens pitch P*. Conversely if the image pitch is less than the lens pitch then the image array will appear to be located below the surface plane. Different image plane "depths" (v) can be achieved through the use of different image slice pitches (Pa, Pb etc).

The result in this example is the first and second images $I_A$ and $I_B$ are visualised by the observer as sitting on a three-dimensional surface formed as a series of flat (and horizontal) areas 6*a* to 6*e* at different apparent heights from one another, as shown best in FIG. 2(*f*). The transition from one area to the next is discrete since the pitch values Pa to Pe increase step-wise across the device in the x-direction as described above. It will be appreciated that the form of the three-dimensional surface can be controlled as desired through appropriate selection of the image slice pitch in each of the areas 6. For example, whilst in the embodiment shown the vertical position v moves up and down across the device, in other cases the areas of different pitch could be arranged so that the vertical position appears to change in the same sense across the device, i.e. upwards or downwards, so as to give the appearance of a staircase.

Whilst the regions $R_1$, $R_2$ of the device (displaying respective first and second images) and the areas 6*a*, 6*b* etc. of the device (displaying different vertical positions) both arise due to the pitch variation in image element array 4, the regions $R_1$, $R_2$ are independent of the areas 6*a*, 6*b* in terms of their size, shape and position. In particular, the size, shape and position of the regions $R_1$, $R_2$ depends on the moiré interference pattern resulting from the combination of the two arrays, which will change with the viewing angle, whilst the size, shape and position of the areas 6*a*, 6*b* etc. is determined by the degree of mis-match between the lens pitch P* and the image slice pitch, which is fixed by the design of the image element array. As such, the areas 6*a*, 6*b* etc remain stationary (in the reference frame of the security device) upon changing the viewing angle, e.g. by tilting the device, whilst the regions $R_1$, $R_2$ will move (and in some cases change size and/or shape) in dependence on the viewing angle, relative to the device and therefore also relative to the areas 6*a*, 6*b* etc. As a result, if the viewing angle is changed sufficiently, one or more of the regions $R_1$, $R_2$ etc may appear to move from one area to another area of the device, in which case the apparent vertical position (depth or height) at which the respective image is displayed will also change. For instance, in the FIG. 2 embodiment, at the viewing angle shown in FIG. 2(*d*), the first region $R_1$ in which part of the house is visible sits mainly in area 6*b* of the device, except its right-most portion which extends into area 6*c*. Therefore the left part of this region $R_1$, falling into area 6*b*, will appear located behind the surface of the device (as explained above) whereas the right part of the same region, falling into area 6*b*, will appear on the surface of the device ($v_0$), i.e. nearer the viewer. At the different viewing angle shown in FIG. 2(*e*), as explained above the region $R_1$ appears to have moved to the left, revealing a different part of the house graphic. This section of the first image $I_A$ falls partially into first area 6*a* and partially into second area 6*b* so once again the section of the image will appear disjointed and to sit on two different image planes, although now the left most part will appear nearer to the viewer than the right part. Similarly, each second region $R_2$ will exhibit the same effects. As the viewing angle is changed, the regions R will appear to move across the device, following the three-dimensional surface defined by the varying vertical position v in which the images are visualised.

It will be noted that in this example, some areas 6 have a vertical position v above the device plane $v_0$ (hence in which the images appear to float) whilst other areas have a vertical position v below the device plane $v_0$ (in which the images appear sunken). Generally it is preferred to include at least one of each type of area in the device in order to increase its three-dimensional appearance. However, this is not essential and examples in which all the areas appear above the device plane $v_0$ or conversely below the device plane $v_0$ will be provided below.

Further, in the FIG. 2 example, the pitch variation in the image element array 4 is discrete from one area to the next (and in the particular example shown, step-wise). This may be desirable in order to clearly distinguish one image level from another, e.g. to produce a sharp, sudden dynamic effect as the images appear to "jump" up and down across the device. However in other embodiments a more subtle movement effect may be preferred in which the change in vertical position is more gradual.

FIG. 3 shows a second embodiment of a security device in accordance with the present invention designed with this in mind, and in which any depth variation present may or may not be apparent to the viewer, depending on the precise configuration of the image slices. The construction and principles of operation of the security device are the same as described above in relation to the FIG. 2 embodiment, except for the arrangement of the image element array 4, and so will not be described again here. Like reference numerals are used to identify like features of all embodiments. As shown in FIG. 3(*b*), here the pitch of the image slices 5 varies not in the second direction (x-axis), as was the case in the FIG. 2 embodiment, but rather in the first direction (y-axis) only. The result is that the image slices 5*a* at the left of the array are substantially rectilinear whilst towards the right of the array, the slices 5*a* become increasingly curved in order to accommodate the pitch between neighbouring image slices being greater approximately half way along the y-axis (Pb) than the pitch along the top and bottom sides of the array (Pa and Pc). In this example, the pitch changes gradually from one area of the device to another, so the three areas labelled 6*a*, 6*b* and 6*c* have no distinct boundaries between them. The pitch between the image slices 5 is approximately equal to the lens pitch P* at the top and bottom of the device (values Pa and Pc shown in FIG. 3(*b*)) whilst it increases gradually to a maximum along a centre line of the device in area 6*b* (value Pb). As in the previous example, any banding or other interference effect appearing in FIGS. 3(*a*) and (*b*) is unintentional, being an artefact of the printing of the Figures, and is not present in practice.

The moiré interference pattern resulting from the combination of the two arrays (at a particular viewing angle as seen by observer $O_1$) is shown in FIG. 3(*c*). As before this comprises a series of alternating dark and light bands which define the various regions $R_1$, $R_2$ of the device in which the respective first and second images will be displayed. In this example, the pattern of regions $R_1$, $R_2$ is more complex than in the previous embodiment, comprising a set of crescent-shaped areas as shown. Due to the same mechanisms already described, the first image $I_A$ will be displayed in the first regions $R_1$ of the device whilst simultaneously the second image $I_B$ will be displayed in the second regions $R_2$ of the device as shown in FIG. 3(*d*) using the same two exemplary images as before. When the viewing angle is changed, the regions $R_1$, $R_2$ will appear to move across the device and/or change in size and/or shape, revealing different sections of each image, as illustrated in FIG. 3(*e*) which depicts the same device from a different viewing angle.

The surface on which the images $I_A$, $I_B$ are visualised will have a varying height due to the varying pitch of the image element array. However this may or may not be apparent to the viewer depending on the degree of pitch variation selected. In this example, the degree of pitch variation is relatively small (e.g. varying by less than 3% between any two places across the array). As a result of this and the gradual nature of the pitch variation, the three-dimensional form of the image surface may not be apparent, or hardly apparent to the viewer. In this case, the vertical position v of the image surface across the line Y-Y' is depicted by the solid line (i) in FIG. 3(*f*). It will be seen that the image surface is relatively smooth and flat, rising up slightly towards the viewer in the centre region 6*b*, which may not be noticeable to the viewer.

Alternatively, the three-dimensional effect may be increased by increasing the degree of pitch variation (the artwork for which is not shown but will have a layout similar to that of FIG. 3(*b*) with a more exaggerated expansion along the centre of the array). The vertical position v of such an exemplary image surface across the line Y-Y' is depicted by the dashed line (ii) in FIG. 3(*f*). It will be seen that the images appear on a continuously curving surface which rises up, towards the viewer, to a peak along a straight line parallel to the x-axis in the centre of region 6*b*.

In both of these examples, the minimum pitch of the image element slices Pa and Pc is approximately equal to the pitch of the lenses P* and so in areas 6*a* and 6*c* the image surface appears to coincide with that of the device $v_0$. As such, in this embodiment the vertical position v of the images remains on or above the device plane at all points across the device. As noted above this is not essential and it may be preferred to arrange for the image surface to intersect the device plane in one or more places to enhance the three-dimensional effect.

As the device is tilted, the regions R move across the device and also appear to slide up or down the three dimensional surface defined by the regions 6 (if this is apparent to the viewer), thereby giving rise to a particularly strong visual effect.

In the first and second embodiments, the pitch variation across the image element array 4 takes place in one dimension only: in the second direction (x-axis) in the FIG. 2 embodiment, and in the first direction (y-axis) in the FIG. 3 embodiment. (It should be noted nonetheless that in both cases the pitch which varies is the spacing between neighbouring image slices from the same image in the second direction, i.e. the x-axis). However, still more complex effects can be obtained by arranging the pitch of the image slices to vary in both the first and second direction across the security device. FIG. 4 illustrates a third embodiment of the invention in which this is the case. Again, the physical construction of the device and the principles on which it operates are the same as described above with respect to FIGS. 1 to 3, apart for the different configuration of the image element array 4 now to be described.

In this example, the image slices 5*a*, 5*b* are rectilinear and arranged non-parallel to one another, at a gradually increasing angle from the y-axis as the position along the x-axis increases. For instance, the paths of the image slices may each lie along radii emanating from a common point of intersection which is located outside the boundaries of the security device in this case. Hence, taking any one position along the x-axis, the pitch between image slices 5*a* continuously increases along the positive y-axis direction and similarly, taking any one position along the y-axis, the pitch between image slices 5*a* continuously increases along the positive x-axis direction. As in the previous examples, any banding or other interference effect appearing in FIGS. 4(*a*) and (*b*) is unintentional, being an artefact of the printing of the Figures, and is not present in practice.

As shown in FIG. 4(*c*) the resulting moiré interference device arising from the two arrays in combination comprises a series of curved bands defining the first and second regions $R_1$, $R_2$ of the device in which the respective images are displayed. FIGS. 4(*d*) and (*e*) show the appearance of the device from two different viewing angles using the same two exemplary images as before and it will be seen that the various regions move across the device upon tilting as previously described.

Due to the pitch variation, the surface on which the images appear takes the form of a flat plane which is inclined relative to the surface of the device along both the x and y axes (in a manner which may or may not be apparent to the viewer depending on the degree of pitch variation). This is illustrated in FIGS. 4(*f*) and (*g*) which show the vertical position v of the image surface along the line X-X' and along the line Y'-Y, respectively (the coordinates x* and y* denoting the point of intersection between lines X-X' and Y'-Y, which has a height v*).

It will be appreciated that the above embodiments illustrate only selected examples of different patterns of image regions R and different shapes of the image surface and in practice any desired patterns and shapes can be formed through appropriate configuration of the image element array 4 and particularly its variation in pitch, following the principles outlined above. The shape of the image surface (as determined by the arrangement of areas 6 and the vertical position v obtained in each) can be random or abstract, but in further preferred embodiments may be configured to display one or more indicia so that it can be used to convey additional information, for example.

FIG. 5 illustrates a fourth embodiment of a security device in accordance with the present invention in which this is the case. Again, the physical construction of the device and the principles on which it operates are the same as described above with respect to FIGS. 1 to 4, apart for the different configuration of the image element array 4 now to be described. As shown in FIG. 5(*b*), here the image element array 4 comprises two area: first area 6*a* has a pitch Pa between image slices 5*a* which substantially matches that of the lenses, P*, whilst second area 6*b* has an increased pitch Pb. The second area 6*b* has the shape of an indicia (here a star, but any other indicia could be used), and the first area 6*a* surrounds the star so as to form a background. As in the previous examples, any banding or other interference effect appearing in FIGS. 5(*a*) and (*b*) is unintentional, being an artefact of the printing of the Figures, and is not present in practice.

The resulting moiré interference pattern formed when the two arrays are overlapped is shown in FIG. 5(*c*) and it will be seen that the dark bands defining the second regions $R_2$ are located only within the second area 6*b* at this viewing angle. Since there is no pitch mismatch in the first area 6*a*, the whole of the first area will display either the first image or the second image at any one viewing angle, as in a conventional lenticular device.

FIG. 5(*d*) shows the appearance of the device from the same viewing angle as in FIG. 5(*c*), utilising the same two exemplary images as in previous embodiments. Thus, the whole of area 6*a* exhibits the first image $I_A$ whilst the star-shaped second area 6*b* displays a series of alternating first and second regions due to the moiré interference effect already explained. Upon tilting to a second viewing angle, as shown in FIG. 5(*e*), the whole of the background (first) area 6*a* switches to display the second image $I_B$ whilst in the star-shaped second area 6*b* the regions $R_1$, $R_2$ move and/or change shape in the same manner as previously described so as to reveal different sections of the two images. As the regions $R_1$, $R_2$ move, their extent will be curtailed by the boundaries of the second area 6*b*, helping to emphasise its shape and thus reveal its information content (i.e. a star, in this case).

Due to the difference in pitch of the image slices 5 between the first and second areas 6*a*, 6*b*, the images $I_A$ and $I_B$ will appear at different vertical positions v in the two respective areas, as shown best in FIGS. 5(*f*) and 5(*g*). In this example, the star-shaped second area 6*b* will appear to float in front of the device plane, whereas its surroundings (first area 6*a*) will appear to lie in the device plane.

More complex indicia can be displayed by the surface(s) on which the images $I_A$, $I_B$ appear to sit through appropriate configuration of the image array 4 and particularly the variation in pitch. The indicia can be formed by one or more discrete areas 6 (as in the present example), and/or by gradually varying the pitch between areas so as to produce tilted or curved portions of the image surface, as in the FIGS. 3 and 4 examples. Examples of indicia that could be displayed in this manner include alphanumeric text (letters and/or numbers), symbols, logos, three-dimensional objects (such as geometric solids, people, animals or buildings) or any other graphics.

The indicia displayed by the image surface in such embodiments may or may not be related to the content of the two or more images $I_A$, $I_B$, either conceptually or physically. For example, the content of image $I_A$ in the FIG. 5 embodiment could exhibit a distinction in the section which falls inside the star-shaped second area 6*b* as compared with that in the background area 6*a*. For example, the image could be formed in a different colour in the two areas, demonstrating a physical relationship between the indicia and the image which increases the difficulty of counterfeiting still further. An example of a conceptual similarity would be a first image depicting a map of a country, whilst the indicia comprises letters bearing the country's name, e.g. "UK".

The images $I_A$, $I_B$ carried by each set of image slices 5*a*, 5*b* could be solid colours but typically will be more complex, carrying for example letters, numbers, symbols, logos, portraits, patterns or any other desired graphics. Thus, in order to carry such information, each of the image slices from any one respective image will typically be different from one another and may also vary along the length of the image slice. This applies to all of the embodiments of the invention described.

Whilst for simplicity each of the embodiments described has comprised only first and second images, in practice any number of different images can be incorporated into the device by interlacing more than two corresponding sets of image slices, in which case each image will be displayed in one or more corresponding regions of the device, all of which will appear to move across the device upon tilting.

In all of the examples given so far, each image slice 5*a*, 5*b* is configured as a single image element which continuously follows the desired path of the image slice. An example of such an image slice 5*a is depicted in FIG. 6**(*b*) which represents one of the image slices in the image array 4 shown in FIG. 6(*a*). This is preferred in many cases since the resulting movement effects will be smooth as the regions move across the device. However, this is not essential and each image slice could in fact be made up of multiple discreet image elements. FIG. 6(*c*) shows an example of how the same image element 5*a shown in FIG. 6**(*b*) could be implemented in this way.

Here, the each image slice 5*a comprises a set of multiple image elements 4***a*, 4*b*, 4*c*, etc. Each individual image element 4*a*, 4*b*, 4*c* is not aligned along the desired path of the image slice 5*a and in this example is parallel to the long axis of the focussing elements (i.e. the Y axis), which is preferred but not essential. The image elements 4***a*, 4*b*, 4*c*, etc. are located at staggered positions along the X and Y axes so together they are arranged approximately along the desired path of the image slice 5*a. Each of the other image slices can be formed of a corresponding set of image elements in a similar manner. The depicted arrangement will give rise to substantially the same visual effect as described previously with respect to FIG. 3. However, due to the discreet nature of the image elements making up the image slice 5*a, the movement effect will appear less smooth. Nonetheless, this can be desirable depending on the design of the device.

Where the image slices 5 are formed of multiple image elements, the image elements are preferably arranged on a regular grid, e.g. an orthogonal grid, and an example of this is shown in FIG. 6(*c*). In this case the image elements are approximately square or rectangular and arranged in a orthogonal grid, the axes of which are parallel to the first and second directions of the device (i.e. X and Y axes). Only the elements 4*a*, 4*b*, 4*c* etc. making up one image slice 5*a** have been shaded in the Figure for clarity but in practice the remaining image elements will be allocated to respective image slices from other images.

In the above-described embodiments, the movement effects will only be exhibited when the viewing angle about the y-axis is changed, since that corresponds to the long axis of the lenses 9 and it is the pitch in the orthogonal x-axis which is varied. As a result, the devices will appear static if the viewing angle changes about the x-axis only. In order to provide movement effects upon tilting in either one direction (and both directions), a security device assembly comprising two or more devices of the sort described above may be provided, and such an embodiment is shown in FIG. 7. Here the security device assembly 10 comprises two security devices 1 and 1', each as described in the FIG. 3 embodiment. However whilst the first security device 1 has the same orientation as previously described, with the long axis of its lenses 9 aligned with the y-axis, the second security device 1' is rotated by 90 degrees relative to the first security device 1 such that its lenses 9 are aligned with the x-axis direction. The result is that the first security device will exhibit motion effects upon tilting the security device assembly 10 about the y-axis whilst the second security device will exhibit the effects upon tilting the assembly about the x-axis. The security assembly as a whole will therefore exhibit motion upon any tilting action. It will be appreciated that the multiple devices 1, 1' could be configured with any desired shape or arrangement so as to denote, for example, a further indicia.

Additionally, whilst the devices shown in the previous embodiments make use of an array 8 of one-dimensional elongate lenses 9 (e.g. cylindrical lenses), substantially the same effects can be achieved using a two-dimensional array of non-elongate lenses (e.g. spherical or aspherical lenses) arranged such that a straight line of such lenses takes the place of each individual elongate lens 9 previously described. The term "elongate focusing structure" is used to encompass both of these options. Hence, in all of the embodiments herein, it should be noted that the elongate lenses 9 described are preferred examples of elongate focussing structures and could be substituted by lines of non-elongate focussing elements. To illustrate this, FIGS. 8(*a*) and (*b*) depict two exemplary focussing element arrays which could be used in any of the presently disclosed embodiments and will achieve substantially the same visual effects already described.

FIG. 8(*a*) shows an array of elongate focusing structures which comprises an orthogonal (square or rectangular) array of focusing elements, e.g. spherical lenses. Each column of lenses arranged along a straight line parallel to the y-axis is considered to constitute one elongate focusing structure 9 and dashed lines delimiting one elongate focusing structure 9 from the next have been inserted to aid visualisation of this. Hence for example the lenses 9*a*, 9*b*, 9*c* and 9*d*, the centre points of which are all aligned along a straight line, form one elongate focusing structure 9. These elongate focusing structures 9 are periodic along the orthogonal direction (x-axis) in the same way as previously described. The first direction can then be defined along the arrow $D_1$, which here is parallel to the y-axis, and the image slices (not shown) will be arranged with the desired variation in their pitch in the orthogonal second direction. The optical footprint of each elongate focusing structure 9 will still be substantially strip shaped but may not be precisely rectangular due to its dependence on the shape of the lenses themselves. As a result the sides of the optical footprint may not be straight but the centre line (defined as the line joining the points equidistant from the two sides of the footprint at each location) will straight and parallel to the first direction $D_1$.

Of course, since the grid of focusing elements is orthogonal, the first direction could be defined in the orthogonal direction $D_2$, in which case each row of lenses along the x-axis would be considered to make up the respective elongate focusing structures 9.

FIG. 8(*b*) shows another array of elongate focusing structures which here comprises a hexagonal (or "close-packed") array of focusing elements such as spherical lenses. Again the columns of adjacent lenses such as 9*a*, 9*b*, 9*c* and 9*d* are taken to form the respective elongate focusing structures (aligned along the y-axis) and those structures are periodic along the orthogonal direction (x-axis). Hence the direction $D_1$ can be defined as the first direction with the image slices arranged with the desired variation in their pitch in the orthogonal direction. However it is also possible to define the direction $D_2$ (which here lies at 60 degrees from $D_1$) as the first direction. It should be noted that the x-axis direction is not suitable in this case for use as the first direction since the adjacent lenses do not all have their centre points on the same straight line in this direction.

As discussed in relation to FIG. 7 above, focussing element arrays such as these are particularly well suited to designs in which different parts of the device (or different adjacent devices in a security device assembly) are configured to operate upon tilting in different directions. This can be achieved for example by using direction $D_1$ as the first direction in a first part of the device (or in a first device) and using direction $D_2$ as the first direction in a second part of the device (or in a second device).

In order to achieve an acceptably low thickness of the security device (e.g. around 70 microns or less where the device is to be formed on a transparent document substrate, such as a polymer banknote, or around 40 microns or less where the device is to be formed on a thread, foil or patch), the pitch of the lenses must also be around the same order of magnitude (e.g. 70 microns or 40 microns). Therefore the width of the image slices 5*a*, 5*b* is preferably no more than half such dimensions, e.g. 35 microns or less.

Figure 9:
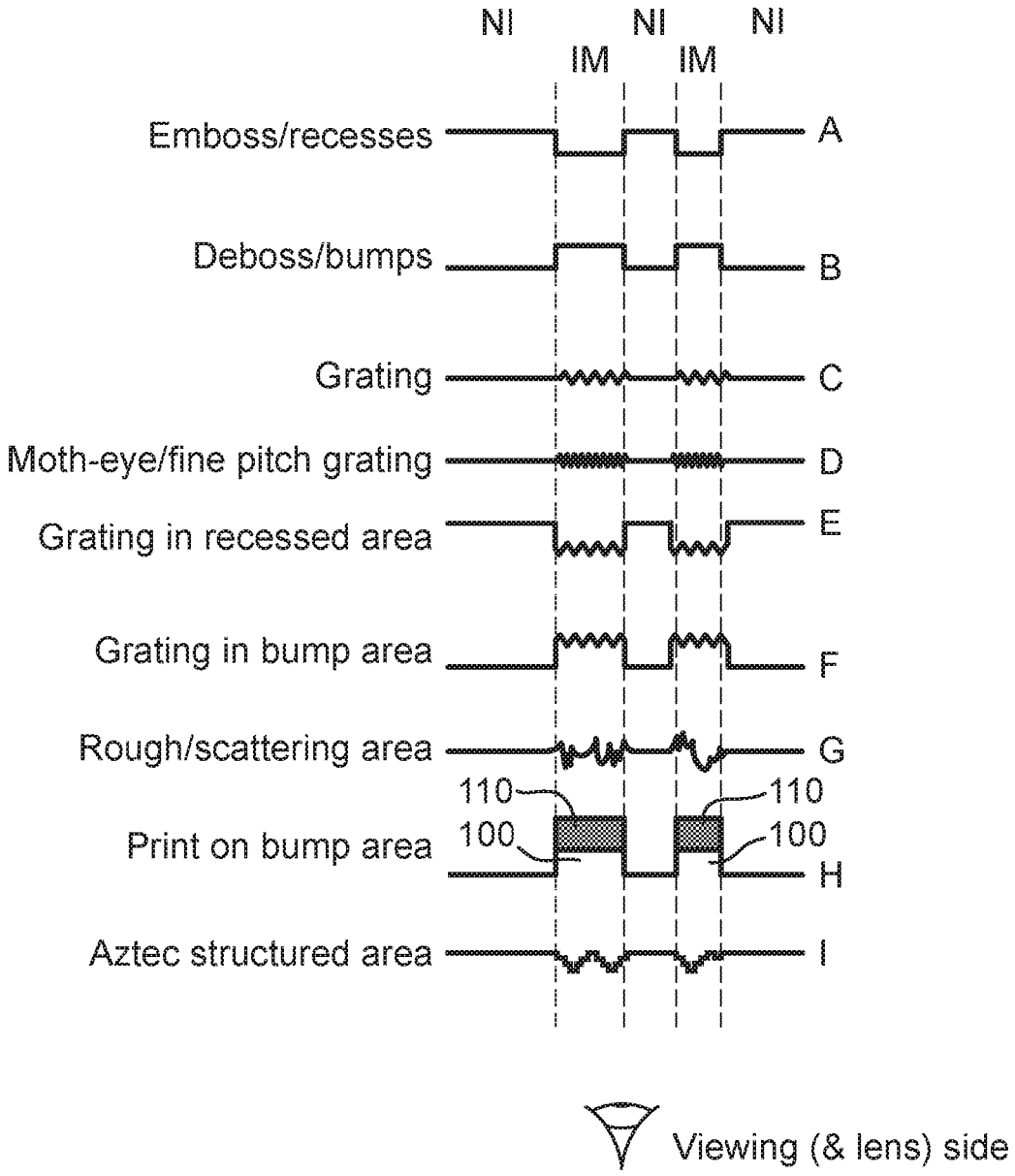

In all of the embodiments, the image elements/slices could be formed in various different ways. For example, the image elements could be formed of ink, for example printed onto the substrate 2 or onto an underlying layer which is then positioned adjacent to the substrate 2. In preferred examples, a magnetic and/or conductive ink could be used for this purpose which will introduce an additional testable security feature to the device. However, in other examples the image elements can be formed by a relief structure and a variety of different relief structure suitable for this are shown in FIG. 9. Thus, FIG. 9*a* illustrates image regions of the image elements (IM) in the form of embossed or recessed regions while the non-embossed portions correspond to the non-imaged regions of the elements (NI). For instance, if one of the images $I_A$, $I_B$ displayed by the device is a solid, uniform colour block then the whole of each image slice 5*a* or 5*b* corresponding to that element will be formed either of an image region (IM) or of a non-image region (NI). However, as mentioned above typically at least one of the images will comprise a more complex graphic and so generally each individual image slice 5*a*, 5*b* will be made up of a mixture of image regions (IM) and non-image regions (NI) as appropriate in order to define the information content of the image slice in question. FIG. 9*b* illustrates image regions of the elements in the form of debossed lines or bumps.

In another approach, the relief structures can be in the form of diffraction gratings (FIG. 9*c*) or moth eye/fine pitch gratings (FIG. 9*d*). Where the image elements are formed by diffraction gratings, then different image portions of an image (within one image element or in different elements) can be formed by gratings with different characteristics. The difference may be in the pitch of the grating or rotation. This can be used to define the image content of either or both images $I_A$, $I_B$. A preferred method for writing such a grating would be to use electron beam writing techniques or dot matrix techniques.

Such diffraction gratings for moth eye/fine pitch gratings can also be located on recesses or bumps such as those of FIGS. 9*a* and *b*, as shown in FIGS. 9*e* and *f* respectively.

FIG. 9*g* illustrates the use of a simple scattering structure providing an achromatic effect.

Further, in some cases the recesses of FIG. 9*a* could be provided with an ink or the debossed regions or bumps in FIG. 9*b* could be provided with an ink.

The latter is shown in FIG. 9*h* where ink layers 110 are provided on the bumps 100, Thus the image areas of each image element could be created by forming appropriate raised regions or bumps in a resin layer provided on a transparent substrate such as item 2 shown in FIG. 1. This could be achieved for example by cast curing or embossing. A coloured ink is then transferred onto the raised regions typically using a lithographic, flexographic or gravure process. In some examples, some image elements could be printed with one colour and other image elements could be printed with a second colour. In this manner either the various different images incorporated in the device could be of different colours to one another and/or, when the device is tilted to create the motion effect described above, the individual images could also be seen to change colour as the regions move along the device. In another example all of the image elements in one portion of the device could be provided in one colour and then all in a different colour in another portion of the device. Again, magnetic and/or conductive ink(s) could be utilised.

Finally, FIG. 9*i* illustrates the use of an Aztec structure.

Additionally, image and non-image areas could be defined by a combination of different element types, e.g. the image areas could be formed from moth eye structures whilst the non-image areas could be formed from gratings. Alternatively, the image and non-image areas could even be formed by gratings of different pitch or orientation.

Where the image elements are formed solely of grating or moth-eye type structures, the relief depth will typically be in the range 0.05 microns to 0.5 microns. For structures such as those shown in FIGS. 9 *a, b, e, f, h* and *i*, the height or depth of the bumps/recesses is preferably in the range 0.5 to 10 μm and more preferably in the range of 1 to 2 μm. The typical width of the bumps or recesses will be defined by the nature of the artwork but will typically be less than 100 μm, more preferably less than 50 μm and even more preferably less than 25 μm. The size of the image elements and therefore the size of the bumps or recesses will be dependent on factors including the type of optical effect required, the size of the focusing elements and the desired device thickness. For example if the width of the focusing elements is 30 μm then each image element may be around 15 μm wide or less. Alternatively for a smooth animation effect it is preferable to have as many views as possible, typically at least three but ideally as many as thirty. In this case the size of the elements (and associated bumps or recesses) should be in the range 0.1 to 6 μm. In theory, there is no limit as to the number of image elements which can be included but in practice as the number increases, the resolution of the displayed images will decrease, since an ever decreasing proportion of the devices surface area is available for the display of each image.

In still further embodiments the image elements could be formed by demetallisation of a metal later, for instance using any of the methods described in our British Patent Application no. 1510073.8.

In practice, however the image elements are formed, the width of the image elements is directly influenced by two factors, namely the pitch of the focusing element (e.g. lens) array and the number of image elements required within each lens pitch or lens base width (although in order to accommodate the pitch variation described above, the width of the image elements will typically vary from place to place across the array). The former however is also indirectly determined by the thickness of the lenticular device. This is because the focal length for a plano-convex lens array (assuming the convex part of the lens is bounded by air and not a varnish) is approximated by the expression $r/(n-1)$, where r is the radius of curvature and n the refractive index of the lens resin.

Since the latter has a value typically between 1.45 and 1.5 then we may say the lens focal length approximates to 2 r (=w). Now for an array of adjacent cylindrical lenses, the base width of the lens is only slightly smaller than the lens pitch, and since the maximum value the base diameter can have is 2 r, it then follows that the maximum value for the lens pitch is close to the value 2 r which closely approximates to the lens focal length and therefore the device thickness.

To give an example, for a security thread component as may be incorporated into a banknote, the thickness of the lenticular structure and therefore the lens focal length is desirably less than 35 μm. Let us suppose we target a thickness and hence a focal length of 30 μm. The maximum base width w we can have is from the previous discussion equal to 2r which closely approximates to the lens focal length of 30 μm. In this scenario the f-number, which equals (focal length/lens base diameter), is very close to 1. The lens pitch can be chosen to have a value only a few μm greater than the lens width—let us choose a value of 32 μm for the lens pitch. It therefore follows for a two channel lenticular device (i.e. two image element slices per unit cell) we need to fit two image strips into 32 μm and therefore each strip is around 16 μm wide (although this may vary to accommodate the desired pitch variation as described above). Such a strip or line width is already well below the resolution of conventional web-based printing techniques such as flexographic, lithographic (wet, waterless & UV) or gravure, which even within the security printing industry have proven print resolutions down to the 50 to 35 μm level at best. Similarly for a four channel lenticular the problem of print resolution becomes more severe as the printed line width requirement drops down to 8 μm (in this example), and so on.

As a result, for ink based printing of the image elements, the f-number of the lens should preferably be minimised, in order to maximise the lens base diameter for a given structure thickness. For example suppose we choose a higher f-number of 3, consequently the lens base width will be 30/3 or 10 μm. Such a lens will be at the boundary of diffractive and refractive physics—however, even if we still consider it to be primarily a diffractive device then the we may assume a lens pitch of say 12 μm. Consider once again the case of a two channel device, now we will need to print an image strip of only about 6 μm and for a four channel device a strip width of only about 3 μm. Conventional printing techniques will generally not be adequate to achieve such high resolution. However, suitable methods for forming the image elements include those described in WO-A-2008/000350, WO-A-2011/102800 and EP-A-2460667.

This is also where using a diffractive structure to provide the image strips provides a major resolution advantage: although ink-based printing is generally preferred for reflective contrast and light source invariance, techniques such as modern e-beam lithography can be used generate to originate diffractive image strips down to widths of 1 μm or less and such ultra-high resolution structures can be efficiently replicated using UV cast cure techniques.

As mentioned above, the thickness of the device 10 is directly related to the size of the focusing elements and so the optical geometry must be taken into account when selecting the thickness of the transparent layer 19. In preferred examples the device thickness is in the range 5 to 200 microns, "Thick" devices at the upper end of this range are suitable for incorporation into documents such as identification cards and drivers licences, as well as into labels and similar. For documents such as banknotes, thinner devices are desired as mentioned above. At the lower end of the range, the limit is set by diffraction effects that arise as the focusing element diameter reduces: e.g. lenses of less than 10 micron base width (hence focal length approximately 10 microns) and more especially less than 5 microns (focal length approximately 5 microns) will tend to suffer from such effects. Therefore the limiting thickness of such structures is believed to lie between about 5 and 10 microns.

In the case of relief structures forming the image elements, these will preferably be embossed or cast cured into a suitable resin layer on the opposite side of the substrate 2 to the lens array 8. The lens array 8 itself can also be made using cast cure or embossing processes, or could be printed using suitable transparent substances as described in U.S. Pat. No. 6,856,462 B. The periodicity and therefore maximum base width of the focusing elements 9 is preferably in the range 5 to 200 μm, more preferably 10 to 60 μm and even more preferably 20 to 40 μm. The f number for the focusing elements is preferably in the range 0.25 to 16 and more preferably 0.5 to 24.

Whilst in the above embodiments, the focusing elements have taken the form of lenses, in all cases these could be substituted by an array of focusing mirror elements. Suitable mirrors could be formed for example by applying a reflective layer such as a suitable metal to the cast-cured or embossed lens relief structure. In embodiments making use of mirrors, the image element array should be semi-transparent, e.g. having a sufficiently low fill factor to allow light to reach the mirrors and then reflect back through the gaps between the image elements. For example, the fill factor would need to be less than $1/\sqrt{2}$ in order that that at least 50% of the incident light is reflected back to the observer on two passes through the image element array.

In all of the embodiments described above, the security level can be increased further by incorporating a magnetic material into the device. This can be achieved in various ways. For example an additional layer may be provided (e.g. under the image element array 4) which may be formed of, or comprise, magnetic material. The whole layer could be magnetic or the magnetic material could be confined to certain areas, e.g. arranged in the form of a pattern or code, such as a barcode. The presence of the magnetic layer could be concealed from one or both sides, e.g. by providing one or more masking layer(s), which may be metal. If the focussing elements are provided by mirrors, a magnetic layer may be located under the mirrors rather than under the image array.

In still preferred cases the magnetic material can be further incorporated into the device by using it in the formation of the image array. For example, in any of the embodiments one or more of the sets of image slices 5*a*, 5*b*, may be formed of a magnetic material, e.g. a magnetic ink. Alternatively, the image slices could be formed by applying a material defining the required parts of each image slice over a background formed of a layer of magnetic material, provided there is a visual contrast between the two materials. For example, the light portions of each image slice 5*a*, 5*b* could be formed by applying a suitable material, e.g. white ink, over a magnetic layer which is preferably dark in colour. This latter option of providing a magnetic background layer is advantageous since the magnetic material can be applied (e.g. printed) at a low resolution without affecting the operation of the device.

Security devices of the sort described above can be incorporated into or applied to any article for which an authenticity check is desirable. In particular, such devices may be applied to or incorporated into documents of value such as banknotes, passports, driving licences, cheques, identification cards etc The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. ER-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer base substrate so that it is viewable from both sides of the finished security substrate.

Methods of incorporating security elements in such a manner are described in ER-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 10 to 13.

FIG. 10 depicts an exemplary document of value 50, here in the form of a banknote. FIG. 10*a* shows the banknote in plan view whilst FIG. 10*b* shows the same banknote in cross-section along the line Q-Q'. In this case, the banknote is a polymer (or hybrid polymer/paper) banknote, having a transparent substrate 51. Two opacifying layers 52*a* and 52*b* are applied to either side of the transparent substrate 51, which may take the form of opacifying coatings such as white ink, or could be paper layers laminated to the substrate 51.

The opacifying layers 52*a* and 52*b* are omitted across an area 55 which forms a window within which the security device is located. As shown best in the cross-section of FIG. 10*b*, an array of focusing elements 56 is provided on one side of the transparent substrate 51, and a corresponding image element array 57 is provided on the opposite surface of the substrate. The focusing element array 56 and image element array 57 are each as described above with respect to any of the disclosed embodiments, such that at least two regions $R_1$ and $R_2$ are displayed, each displaying a respective image, at each viewing angle. When the document is viewed from the side of lens array 56, the aforementioned motion effect can be viewed upon tilting the device. In this case, the first direction along which the focusing elements are aligned is parallel to the long edge of the document (x-axis). This results in the first and second regions $R_1$, $R_2$ appearing to move within the window 55 as the document is tilted vertically (about the x axis). It should be noted that in modifications of this embodiment the window 55 could be a half-window with the opacifying layer 52*b* continuing across all or part of the window over the image element array 57. In this case, the window will not be transparent but may (or may not) still appear relatively translucent compared to its surroundings. The banknote may also comprise a series of windows or half-windows. In this case the different regions displayed by the security device could appear in different ones of the windows, at least at some viewing angles, and could move from one window to another upon tilting.

FIG. 11 shows such an example, although here the banknote 50 is a conventional paper-based banknote provided with a security article 60 in the form of a security thread, which is inserted during paper-making such that it is partially embedded into the paper so that portions of the paper 53 and 54 lie on either side of the thread. This can be done using the techniques described in EP0059056 where paper is not formed in the window regions during the paper making process thus exposing the security thread in is incorporated between layers 53 and 54 of the paper. The security thread 60 is exposed in window regions 65 of the banknote. Alternatively the window regions 65 which may for example be formed by abrading the surface of the paper in these regions after insertion of the thread. The security device is formed on the thread 60, which comprises a transparent substrate 63 with lens array 61 provided on one side and image element array 62 provided on the other. In the illustration, the lens array 61 is depicted as being discontinuous between each exposed region of the thread, although in practice typically this will not be the case and the security device will be formed continuously along the thread. In this example, the first direction of the device is formed parallel to the short edge of the document 50 (y-axis) and the interference pattern is such that, at least at some viewing angles, different ones of the regions (displaying different images) will appear in each window 65. For example, a central window may display a first region $R_1$ (and hence the first image) whilst top and bottom windows may display second regions $R_2$, each displaying a second image. As the note is tilted about the X axis (i.e. horizontally, in this example), the regions $R_1$, $R_2$ appear to move across the windows and may move from one window 65 to the next.

Alternatively several security devices could be arranged along the thread (e.g. so as to form a security device assembly 10 as described above), with different or identical images displayed by each. In one example, a first window could contain a first device, and a second window could contain a second device, each having their focusing elements arranged along different (preferably orthogonal) directions, so that the two windows display different effects upon tilting in any one direction. For instance, the central window may be configured to exhibit a motion effect when the document 50 is tilted about the X axis whilst the devices in the top and bottom windows remain static, and vice versa when the document is tilted about the Y axis.

In FIG. 12, the banknote 50 is again a conventional paper-based banknote, provided with a strip element or insert 60. The strip 60 is based on a transparent substrate 63 and is inserted between two plies of paper 53 and 54. The security device is formed by a lens array 61 on one side of the strip substrate 63, and an image element array 62 on the other. The paper plies 53 and 54 are apertured across region 65 to reveal the security device, which in this case may be present across the whole of the strip 60 or could be localised within the aperture region 65. The focusing elements 61 are arranged with their long direction along the X axis which here is parallel to the long edge of the note. Hence the regions $R_1$, $R_2$ will appear to move upon tilting the note about the X-axis.

A further embodiment is shown in FIG. 13 where FIGS. 13(*a*) and (*b*) show the front and rear sides of the document respectively, and FIG. 13(*c*) is a cross section along line Z-Z'. Security article 60 is a strip or band comprising a security device according to any of the embodiments described above. The security article 60 is formed into a security document 50 comprising a fibrous substrate 53, using a method described in EP-A-1141480. The strip is incorporated into the security document such that it is fully exposed on one side of the document (FIG. 13(*a*)) and exposed in one or more windows 65 on the opposite side of the document (FIG. 13(*b*)). Again, the security device is formed on the strip 60, which comprises a transparent substrate 63 with a lens array 61 formed on one surface and image element array 62 formed on the other.

In FIG. 13, the document of value 50 is again a conventional paper-based banknote and again includes a strip element 60. In this case there is a single ply of paper. Alternatively a similar construction can be achieved by providing paper 53 with an aperture 65 and adhering the strip element 60 is adhered on to one side of the paper 53 across the aperture 65. The aperture may be formed during papermaking or after papermaking for example by die-cutting or laser cutting. Again, the security device is formed on the strip 60, which comprises a transparent substrate 63 with a lens array 61 formed on one surface and image element array 62 formed on the other.

In general, when applying a security article such as a strip or patch carrying the security device to a document, it is preferable to have the side of the device carrying the image element array bonded to the document substrate and not the lens side, since contact between lenses and an adhesive can render the lenses inoperative. However, the adhesive could be applied to the lens array as a pattern that the leaves an intended windowed zone of the lens array uncoated, with the strip or patch then being applied in register (in the machine direction of the substrate) so the uncoated lens region registers with the substrate hole or window It is also worth noting that since the device only exhibits the optical effect when viewed from one side, it is not especially advantageous to apply over a window region and indeed it could be applied over a non-windowed substrate. Similarly, in the context of a polymer substrate, the device is well-suited to arranging in half-window locations.

The invention claimed is:

1. A security device comprising:

an array of elongate focusing structures, wherein an elongate axis of each elongate focussing element is aligned along a first direction, the elongate focusing structures being arranged parallel to one another periodically along a second direction which is orthogonal to the first direction, each elongate focusing structure having an optical footprint so that different elongate strips are directed to a viewer in dependence on a viewing angle, a centre line of each optical footprint being parallel with the first direction; and an array of image elements overlapping the array of elongate focusing structures, the array of image elements representing elongate image slices of at least two respective images, each image slice comprising one or more image elements, and at least one image slice of each respective image being located at least partially in the optical footprint of each elongate focusing structure;

wherein the array of image elements is configured such that a spacing between neighbouring elongate image slices of each respective image in the second direction varies across the array of image elements in the first and/or second direction(s);

whereby, at any one viewing angle, in a first region of the device the elongate focussing structures direct portions of first image slices corresponding to a first image to the viewer such that the first image is displayed across the first region of the device, and simultaneously, in a second region of the device which is laterally offset from the first region in the first and/or second direction(s), the elongate focussing structures direct portions of second image slices corresponding to a second image to the viewer such that the second image is displayed across the second region of the device, wherein a position of the first region and a position of the second region relative to the security device depend on the viewing angle.

2. A security device according to claim 1, wherein:

each elongate image slice is arranged along a path;

paths of the elongate image slices are parallel to one another across the security device; and the spacing between the neighbouring elongate image slices of each respective image in the second direction vary across the array of image elements in the second direction only.

3. A security device according to claim 1, wherein:

each elongate image slice is arranged along a path;

paths of the elongate image slices are configured such that a distance between adjacent elongate image slices varies across the security device in the first direction, whereby at least some of the elongate image slices are not parallel to one another along at least part of their length, such that the spacing between the neighbouring elongate image slices of each respective image in the second direction varies across the array of image elements in the first direction.

4. A security device according to claim 3, wherein the array of image elements is configured to include elongate image slices arranged along respective paths of different shape from one another.

5. A security device according to claim 3, wherein the array of image elements is configured to include elongate image slices arranged on respective rectilinear paths having a non-zero and non-orthogonal angle to one another.

6. A security device according to claim 3, wherein the array of image elements is configured such that the spacing between the neighbouring elongate image slices of each respective image in the second direction additionally varies across the array of image elements in the second direction.

7. A security device according to claim 1, wherein the array of image elements is configured such that the spacing between the neighbouring elongate image slices of each respective image in the second direction varies across the array of image elements in the first and/or second direction(s) continuously across at least part of the security device.

8. A security device according to claim 1, wherein the array of image elements is configured such that the spacing between the neighbouring elongate image slices of each respective image in the second direction varies across the array of image elements in the first and/or second direction(s) step-wise.

9. A security device according to claim 1, wherein the array of image elements is configured such that the spacing between the neighbouring elongate image slices of each respective image in the second direction is different in respective first and second areas of the security device in such a way that an apparent depth of the displayed first and second images is different in the respective first and second areas of the security device.

10. A security device according to claim 1, wherein in a first area of the security device, a spacing between neighbouring elongate focussing structures in the array of elongate focusing structures in the second direction is greater than the spacing between the neighbouring elongate image slices of each respective image in the second direction, whereby in the first area of the security device, the first and/or second images appear below a plane of the security device; and in a second area of the security device, a spacing between neighbouring elongate focussing structures in the array of elongate focusing structures in the second direction is smaller than the spacing between the neighbouring elongate image slices of each respective image in the second direction, whereby in the second area of the security device, the first and/or second images appear above the plane of the security device.

11. A security device according to claim 1, wherein a variation in the spacing between the neighbouring elongate image slices of each respective image is configured in accordance with selected indicia such that an apparent depth of the first and second images across the security device appears to define a three-dimensional surface having a shape of the selected indicia.

12. A security device according to claim 1, wherein each elongate image slice is arranged along a path and comprises a corresponding elongate image element extending along the path such that the elongate image slice is arranged along the path in a continuous manner.

13. A security device according to claim 1, wherein each elongate image slice is arranged along a path and comprises a set of at least two image elements positioned along the path such that the elongate image slice is arranged along the path in a discrete and/or stepwise manner.

14. A security device according to claim 1, wherein the array of image elements is configured such that the first image is displayed across at least two first regions of the security device, and simultaneously, the second image is displayed across at least two second regions of the security device which are laterally offset from the at least two first regions.

15. A security device according to claim 1, wherein each elongate focusing structure comprises an elongate focusing element.

16. A security device according to claim 1, wherein each elongate focusing structure comprises a plurality of focusing elements, arranged such that a centre point of each focusing element is aligned along a straight line in the first direction.

17. A security device assembly comprising at least two security devices each in accordance with claim 1, wherein the first direction along which the elongate focusing structures are aligned in each security device is different.

18. A security device according to claim 1, wherein the security device or security device assembly is formed as a security thread, strip, foil, insert, label or patch.

19. An article provided with a security device or security device assembly according to claim 1.

20. A method of manufacturing a security device, the method comprising:

providing an array of elongate focusing structures, wherein an elongate axis of each elongate focussing element is aligned along a first direction, the elongate focusing structures being arranged parallel to one another periodically along a second direction which is orthogonal to the first direction, each elongate focusing structure having an optical footprint so that different elongate strips are directed to a viewer in dependence on a viewing angle, a centre line of each optical footprint being parallel with the first direction; and providing an array of image elements overlapping the array of elongate focusing structures, the array of image elements representing elongate image slices of at least two respective images, each image slice comprising one or more image elements, and at least one image slice of each respective image being located at least partially in the optical footprint of each elongate focusing structure;

wherein the array of image elements is configured such that a spacing between neighbouring elongate image slices of each respective image in the second direction varies across the array of image elements in the first and/or second direction(s);

whereby, at any one viewing angle, in a first region of the device the elongate focussing structures direct portions of first image slices corresponding to a first image to the viewer such that the first image is displayed across the first region of the device, and simultaneously, in a second region of the device which is laterally offset from the first region in the first and/or second direction(s), the elongate focussing structures direct portions of second image slices corresponding to a second image to the viewer such that the second image is displayed across the second region of the device;

wherein a position of the first region and a position of the second region relative to the security device depend on the viewing angle.

* * * * *